US012575667B2

(12) United States Patent
Crudo et al.

(10) Patent No.: US 12,575,667 B2
(45) Date of Patent: Mar. 17, 2026

(54) TABLETOP BUMPER KIT

(71) Applicant: NPS Public Furniture Corp., Clifton, NJ (US)

(72) Inventors: Alexander Crudo, Hoboken, NJ (US); Yehuda Freundlich, Passaic, NJ (US); Elchonon M. Jacobson, Passaic, NJ (US)

(73) Assignee: NPS Public Furniture Corp., Clifton, NJ (US)

( * ) Notice: Subject to any disclaimer, the term of this patent is extended or adjusted under 35 U.S.C. 154(b) by 55 days.

(21) Appl. No.: 18/418,587

(22) Filed: Jan. 22, 2024

(65) Prior Publication Data

US 2025/0234991 A1 Jul. 24, 2025

(51) Int. Cl.
*A47B 13/08* (2006.01)

(52) U.S. Cl.
CPC .... *A47B 13/083* (2013.01); *A47B 2200/0084* (2013.01); *A47B 2220/0061* (2013.01)

(58) Field of Classification Search
CPC ..... A47B 13/083; A47B 2200/0084; A47B 2200/0061
USPC ..... 312/137, 140; 108/27
See application file for complete search history.

(56) References Cited

U.S. PATENT DOCUMENTS 995,410 A * 6/1911 McClure ..... A47F 3/007 312/137
1,067,511 A * 7/1913 Egelund ..... A47F 5/005 312/140
1,138,974 A * 5/1915 Ramsay ..... A47B 77/022 108/27
1,706,345 A * 3/1929 Bleakley ..... A47F 5/005 312/137
1,961,486 A * 6/1934 Hall ..... A47F 5/005 211/184

(Continued)

FOREIGN PATENT DOCUMENTS

KR 20220000860 U * 4/2022 ..... A47B 17/04
KR 200497767 Y1 * 2/2024 ..... A47B 95/00

OTHER PUBLICATIONS

"Robotics Bumper Kit—Fits 42" D × 84" W Tables by CEF, RBK-4284-XXX—Stock #87206," Worthington Direct, https://www.worthingtondirect.com/robotics-bumper-kit-fits-42-d-x-84-w-tables htm, Retrieved on Dec. 19, 2023.

(Continued)

*Primary Examiner* — Daniel J Troy
*Assistant Examiner* — Timothy M Ayres
(74) *Attorney, Agent, or Firm* — Weiss & Arons LLP

(57) ABSTRACT

Systems and methods for providing a tabletop bumper kit system. The tabletop bumper kit includes a plurality of bumpers, a plurality of tabletop corner bracket assemblies, and a plurality of side support brackets. The plurality of tabletop corner bracket assemblies attaches to a plurality of corners of a tabletop. The plurality of side support brackets attaches to a plurality of sides of a tabletop. Each of the plurality of bumpers are inserted into the plurality of tabletop corner bracket assemblies and the plurality of side support brackets. Adjustable clamps, found in the tabletop corner bracket assemblies and side support brackets, fasten the bumpers to the tabletop. The adjustable clamps may make the tabletop bumper kit removable.

5 Claims, 31 Drawing Sheets

(56) References Cited

U.S. PATENT DOCUMENTS

| | | | | | |
|---|---|---|---|---|---|
| 3,610,562 | A * | 10/1971 | Holmes | G09F 7/205 | 434/420 |
| 5,076,255 | A * | 12/1991 | Harrison | F24C 15/36 | 126/22 |
| 5,404,684 | A * | 4/1995 | Schwendeman | F16B 5/0614 | 52/287.1 |
| 8,038,233 | B2 * | 10/2011 | Pezzoni | A47F 3/12 | 312/138.1 |
| 10,285,381 | B2 * | 5/2019 | Vanderdys | A47B 13/083 | |
| 10,485,343 | B2 * | 11/2019 | Clark | A47B 91/005 | |
| 11,445,818 | B2 * | 9/2022 | Schwartz | A47B 41/06 | |
| 11,825,948 | B1 * | 11/2023 | Stuckenschneider | A47B 96/201 | |
| 2012/0304441 | A1 * | 12/2012 | Henriott | A47B 13/00 | 29/428 |

OTHER PUBLICATIONS

"Classroom Select Project Bumper Frame Kit," School Specialty, https://www.schoolspecialty.com/en/ssistore/classroom-select-project-bumper-frame-kit-4000337, Retrieved on Dec. 19, 2023.

"Table Bumper Kit," https://res.cloudinary.com/da3rom333/image/upload/v1699033788/Product%20Assets/Literature/Sell%20Sheets/SellSheet_NPS_Table_Bumper_Kit_fxtyd9.pdf, Retrieved on Dec. 19, 2023.

* cited by examiner

TABLETOP BUMPER KIT

FIELD OF TECHNOLOGY

Aspects of the disclosure relate to mechanical designs and apparatus. Specifically, aspects of the disclosure relate to tabletop bumper kits.

BACKGROUND OF THE DISCLOSURE

Furniture plays a significant role in everyday activities. Exemplary activities may relate to the workplace, the home, retail locations, office settings, educational locations, eateries, leisure, and any other activity that may utilize a table.

In some embodiments, tables provide a surface. Tables can be used for storage, activities and/or for other uses. There may be different tables that are efficient for different uses. In some embodiments, a table with a bumper may be provided, i.e. surfaces that surround the tabletop up to a predetermined height. Tables can have bumpers along the perimeter of the table. Tables with bumpers can provide a surface area for rove, robotics, Lego, tabletop soccer, sand activities and/or other activities. Tables with bumpers may not be used for other table uses. Therefore, tables with bumpers may provide utility other than those provided by the tables without bumpers.

It would be desirable to provide systems and methods for creating a tabletop bumper kit that can be attached and removed from a rectangular table. It would be further desirable for the tabletop bumper kit to attach to any rectangular table.

SUMMARY OF THE DISCLOSURE

Aspects of the disclosure relate to a tabletop bumper kit. The tabletop bumper kit may attach to any rectangular tabletop. For purposes of this application, a tabletop may be a top of a table. The tabletop bumper kit may be removed from the rectangular tabletop. The tabletop bumper kit may preferably attach to the tabletop without the use of additional tools.

The tabletop bumper kit may include a plurality of corner bracket assemblies. The tabletop bumper kit may include a plurality of bumpers. The tabletop bumper kit may include a plurality of side clamps. The tabletop bumper kit may be assembled on, and attached to, a tabletop.

The tabletop, for use with embodiments set forth herein, may preferably be a tabletop that does not have obstructions. The tabletop may be on a table with a plurality of corners. There may preferably be four corners on the tabletop though additional corners may be possible. The tabletop may have a top side and a bottom side.

Tabletop corner bracket assemblies may be included in the tabletop bumper kit. A tabletop corner bracket assembly system may be provided. There may be four tabletop corner bracket assemblies for attachment to the four corners of the tabletop. The tabletop corner bracket assembly may attach to the table with use of an adjustable clamp that may be part of the tabletop corner bracket assembly. Each of the tabletop corner bracket assemblies may have a plurality of panel sleeves. Each of the panel sleeves may hold one end of a bumper.

There may be a four or more bumpers included in the tabletop bumper kit. Each of the four bumpers may be slightly smaller than the length of each of the four sides of the tabletop. The bumpers may be a flat rectangular panel having a length, a width and a depth. The bumpers may have six or more sides. A width side, with respect to the tabletop, of the bumper may slide into one of a plurality of sleeves in a tabletop corner bracket assembly. A second width side, with respect to the tabletop, may slide into one of the two panel sleeves in a second tabletop corner bracket assembly. The right side may be facing outward. The left side may be facing the inside of the table.

There may be four or more side support brackets included in the tabletop bumper kit. Each of the side support brackets may include two or more screws. One of the screws may clamp the side support bracket onto the tabletop according to the height of the tabletop. Another one of the screws may clamp the side support bracket onto the bumper according to the width of the bumper. The side support brackets may connect the middle of the bumpers to the tabletop. The side support brackets may be adjustable side clamps. The side support brackets may ensure that the bumpers are fastened to the table providing an enclosed area on the tabletop.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

DETAILED DESCRIPTION OF THE DISCLOSURE

Figure 1:
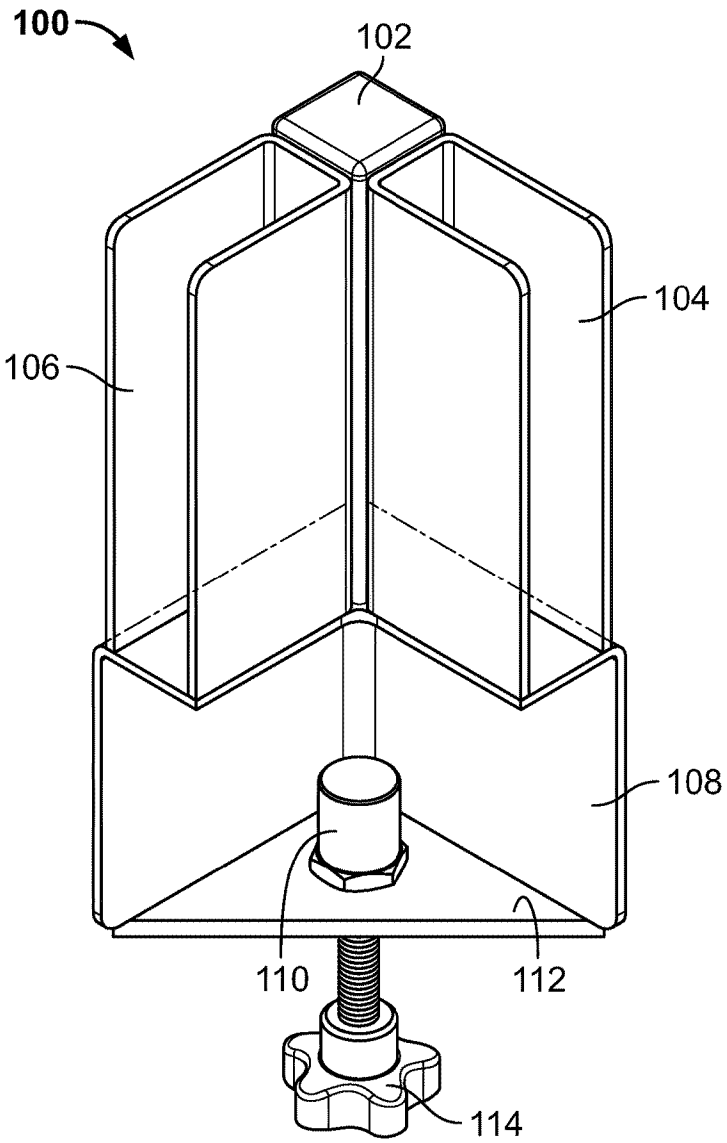
FIG. 1 shows an illustrative apparatus in accordance with principles of this matter.

A tabletop bumper kit is provided. The tabletop bumper kit may include a plurality of bumpers. The tabletop bumper kit may include a plurality of side support brackets. The tabletop bumper kit may include a plurality of tabletop corner bracket assemblies. The tabletop bumper kit may or may not include a table with a tabletop. A table with a tabletop may be necessary for placement and use of the tabletop bumper kit.

The bumpers may be wood bumpers, plastic bumpers and/or bumpers made from any suitable material. The length of the bumpers may be a length smaller than the length of the side of the table to ensure that the tabletop corner bracket assemblies may hold the bumpers.

The tabletop bumper kit may include tabletop corner bracket assemblies. The tabletop corner bracket assemblies may be in the shape of a corner.

The tabletop corner bracket assemblies may include a corner bracket. The corner bracket may be formed from a sheet of steel or any other suitable material. The sheet may include six or more sides. The six or more sides may include a top side, a bottom side, a first inner side, a second inner side, a first outer side and a second outer side.

The top side may be in the shape of an "L". The top side may extend from the corner in two directions. The two directions of the "L" may extend the same length. The top side may have another side underneath it. The underneath side may be the bottom side. The bottom side may be the same shape as the top side and may be visible from an underneath perspective. The top side may have edges. There may be a right outer edge and a left outer edge. There may be a right inner edge and a left inner edge.

The two outer sides may be described as descending from outer perimeters. The first outer side may descend from one of the outer perimeters. The second outer side may descend from a second outer perimeter.

There may be one or more corner posts included in each of the tabletop corner bracket assemblies. The corner post may be of a square tube shape with a length, a width and a depth. The corner post may have six sides. The six sides may be a top side, a bottom side, a right inner side, a left inner side, a right outer side and a left outer side. The top side and the bottom side may be empty sides. The right inner side, left inner side, right outer side and left outer side may be made from a material. The material may be steel, plastic, carbon composite or any other suitable material.

There may be two panel sleeves included in the tabletop corner bracket assemblies. The panel sleeves may have multiple sides. The multiple sides may include a closed end side, a right outer side, a left outer side, an opened end, a right inner side, a left inner side, a middle side and/or other sides.

The closed end from one of the panel sleeves may be welded onto the right inner side of the corner post. The closed end from a second panel sleeve found among the plurality of panel sleeves may be welded onto the left inner side of the corner post. The welding of the second panel sleeve may be orthogonal to the welding of the first panel sleeve. The welding forms an adjoining edge with the two panel sleeves. The welding of the first panel sleeve and the second panel sleeve may form an "L" shape. The "L" shape may have a bottom and a top and may be a top welded assembly. The bottom of the "L" shape may be welded onto the top side of the corner bracket.

There may be a bottom flange included in the tabletop corner bracket assembly. The bottom flange may be made of material. The material may be acrylic, plastic, steel, metal, carbon composite and/or other suitable materials. The bottom flange may be a triangular shape. The triangular shape may have two sharp points. The third point may be a flat point. The bottom flange may have a perimeter. The perimeter may have four edges which may be a right line, a left line, a front line and a back line. The right line, back line and left line may be welded onto the bottom edge of the two walls of the corner bracket.

There may be an aperture in the center of the bottom flange. The aperture may be a threaded aperture.

There may be a pressure screw included among each of the plurality of tabletop corner bracket assemblies. The pressure screw may be threaded through the aperture in the bottom flange.

There may be a clamp end included among each of the plurality of tabletop corner bracket assemblies. The clamp end may have a threaded cavity. The pressure screw may screw into the threaded cavity of the clamp end after it is screwed into the threaded aperture. The clamp end may securely hold the pressure screw in the aperture. The pressure screw, bottom flange, aperture and clamp end may form an adjustable clamp. The adjustable clamp may be formed from the bottom side of the corner bracket and the clamp end, by screwing the pressure screw. The adjustable clamp may be used to fasten the tabletop corner bracket assembly to the table from underneath the tabletop.

The tabletop bumper kit may involve a table that is not provided with the kit. The table may include a tabletop. The tabletop may include four or more corners. The tabletop may be square. Each of the four corners may be adjacent to a perimeter of the tabletop. Being adjacent to the perimeter may include being within one, two, three, four, five, or any other suitable relatively small number of inches from the perimeter. The tabletop should be an unobstructed suitable surface for providing a seat for the clamp underneath the table. Each of the corner bracket assemblies may clamp onto each of the corners of the tabletop.

Following deployment, the tabletop corner bracket assemblies may be located on the corner of the tabletop. The adjustable clamp, which is underneath the corner bracket, may be fastened and tightened to adjust to the thickness of the tabletop. The clamp, preferably, securely fastens the tabletop corner bracket assembly to the tabletop.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure. The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design (CAD) software.

All ranges and parameters disclosed herein shall be understood to encompass any and all subranges subsumed therein, every number between the endpoints, and the endpoints. For example, a stated range of "1 to 10" should be considered to include any and all subranges between (and inclusive of) the minimum value of 1 and the maximum value of 10; that is, all subranges beginning with a minimum value of 1 or more (e.g. 1 to 6.1), and ending with a maximum value of 10 or less (e.g., 2.3 to 10.4, 3 to 8, 4 to 7), and finally to each number 1, 2, 3, 4, 5, 6, 7, 8, 9, and 10 contained within the range.

FIG. 1 shows tabletop corner bracket assembly 100. Tabletop corner bracket assembly 100 may be a corner bracket assembly that can attach to a tabletop. Tabletop corner bracket assembly 100 may be included in a tabletop bumper kit. There may be a plurality of tabletop corner bracket assemblies included in the tabletop bumper kit. The plurality of tabletop corner bracket assemblies may include four or more tabletop corner bracket assemblies. Each of the tabletop corner bracket assemblies may attach to a corner of a tabletop to form a structural framework for the tabletop bumper kit.

Tabletop corner bracket assembly 100 may include components 102, 104, 106, 108, 110, 112, 114 and/or other components. The components of tabletop corner bracket assembly 100 may contribute to attaching tabletop corner bracket assembly 100 to a corner of a tabletop.

Figure 2B:
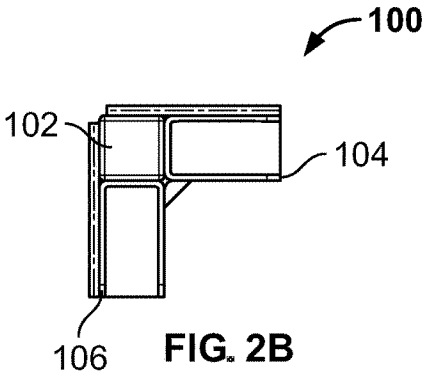
FIG. 2A-2C shows another illustrative apparatus in accordance with principles of this matter.
Figure 2C:
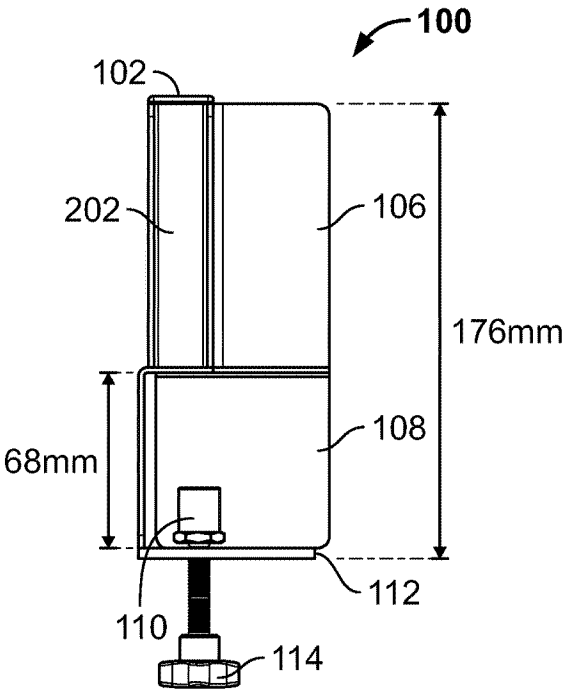
Figure 2A:
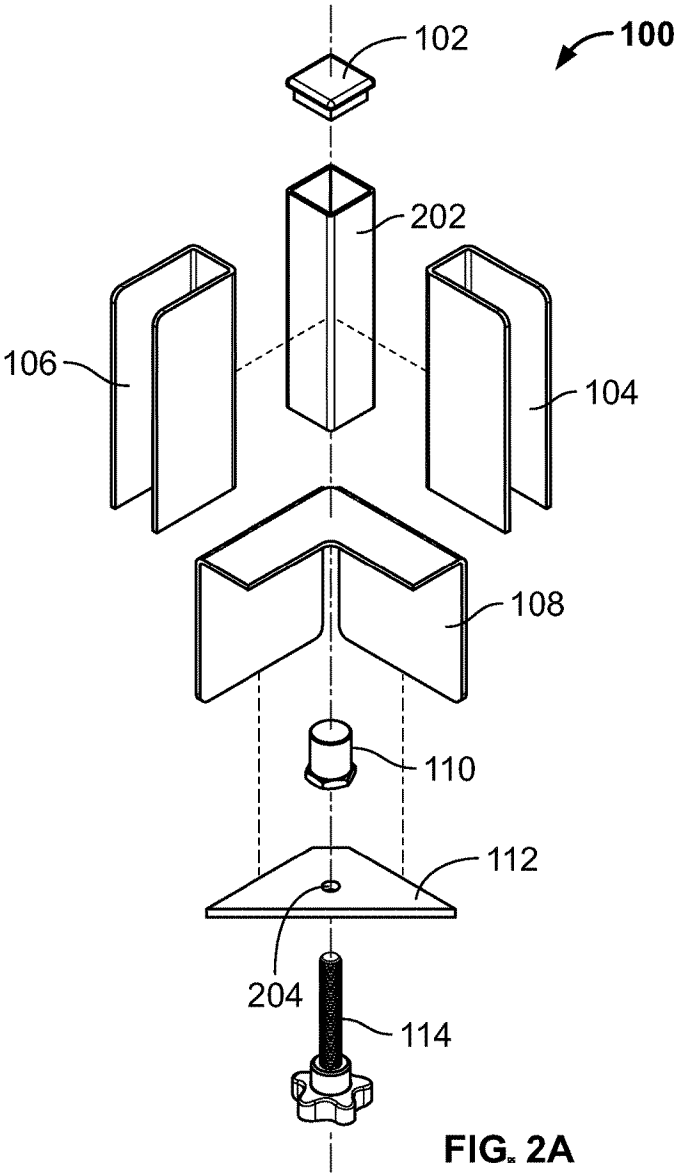

FIG. 2A shows tabletop corner bracket assembly 100 with its components. Corner post 202 may be included in tabletop corner bracket assembly 100. Panel sleeves 104 and 106 may be included in tabletop corner bracket assembly 100. Corner post 202 and panel sleeves 104 and 106 may be welded together. The welding of corner post 202 and panel sleeves 104 and 106 may form an "L" shape assembly.

Corner bracket 108 may be a component of tabletop corner bracket assembly 100. Corner bracket 108 may include a topside. The topside of corner bracket 108 may be an "L" shape. The "L" shape, formed by the welding of corner post 202 and panel sleeves 104 and 106, may fit onto the "L" shape of corner bracket 108. The "L" shape may be welded onto the topside of corner bracket 108.

There may be post end cap 102 that may be included in tabletop corner bracket assembly 100. Post end cap 102 may fit directly into corner post 202. Post end cap 102 may be a cover for corner post 202. There may be one or more post end caps included in tabletop corner bracket assembly 100.

Bottom flange 112 may be included in tabletop corner bracket assembly 100. Bottom flange 112 may be a triangular shape. Bottom flange 112 may be welded at the sides to the bottom of corner bracket 108. Bottom flange 112 may include aperture 204. Aperture 204 may be a threaded aperture. Aperture 204 may be used to hold pressure screw 114. Pressure screw 114 may be threaded through aperture 204. There may be one or more apertures found in bottom flange 112. There may be one or more pressure screws included in tabletop corner bracket assembly 100.

Clamp end 110 may be included in tabletop corner bracket assembly 100. Clamp end 110 may include a cavity. The cavity may be a threaded cavity. Pressure screw 114 may be screwed into clamp end 110. Pressure screw 114, bottom flange 112, aperture 204 and clamp end 110 may produce an adjustable clamp.

Tabletop corner bracket assembly 100 may be placed on a tabletop. The placement of tabletop corner bracket assembly 100 may be with the adjustable clamp. The "L" shaped topside of corner bracket 108 may sit on the tabletop. The tabletop may be any suitable thickness. Adjustable clamp, including pressure screw 114, bottom flange 112, aperture 204 and clamp end 110, may adjust to any size tabletop width. This may be done by screwing pressure screw 114 along with clamp end 110 into the tabletop.

The dotted lines in FIG. 2A show where the welding occurs. There may be welding lines in between corner post 202, panel sleeve 106 and panel sleeve 104. There may be welding lines in between corner post 202 and corner bracket 108. There may be welding lines between corner bracket 108 and bottom flange 112. The fragmented line in FIG. 2A may show the alignment of tabletop corner bracket assembly 100.

FIG. 2B shows a topside view of tabletop corner bracket assembly 100. The topside view of tabletop corner bracket assembly 100 may show a topside view of post end cap 102, panel sleeve 104 and panel sleeve 106.

FIG. 2C shows a side view of tabletop corner bracket assembly 100. The side view of tabletop corner bracket assembly 100 may include a side view of post end cap 102, panel sleeve 106, corner post 202, corner bracket 108, clamp end 110, bottom flange 112 and pressure screw 114. The height of tabletop corner bracket assembly 100 from the bottom of bottom flange 112 to the top of panel sleeve 106 may be on or about 176 millimeters or anywhere between 5% of 176 millimeters. Millimeters may be represented in the figures with a "mm". For the purposes of this application, any numbers listed as measurements may be on, about or within 5% of the number. The height of the bottom of bottom flange 112 until the top of corner bracket 108 may be on or about 68 millimeters or anywhere between 5% of 68 millimeters. The height of tabletop corner bracket assembly 100 with the screw may be unidentified as the height may be adjusted in according with the width of the tabletop.

The length of long side of either panel sleeve 104 or panel sleeve 106 may be on or about 45 millimeters or anywhere within 5% of 45 millimeters. The length of a side of corner post 202 may be on or about 25 millimeters or anywhere within 5% of 25 millimeters. The length and width of tabletop corner bracket assembly 100 may be on or about 70 millimeters or anywhere between 5% of 70 millimeters.

Figure 3:
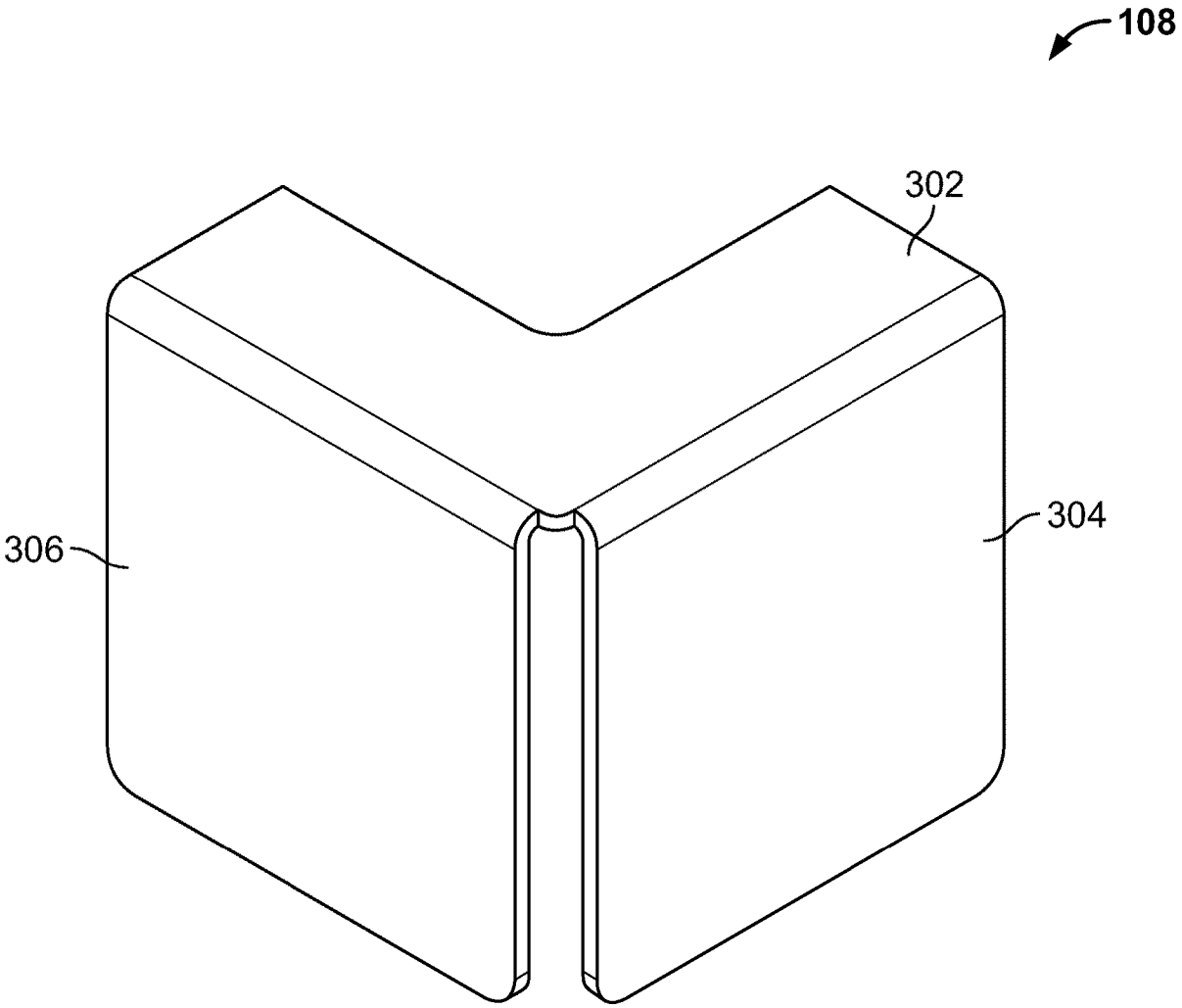
FIG. 3 shows yet another illustrative apparatus in accordance with principles of this matter.

FIG. 3 shows corner bracket 108. Corner bracket 108 may be produced from a piece of material. The material corner bracket 108 may be produced from may be steel. The steel may be 13-gauge steel. Other gauge steel may also be used. There may be a finish on the steel. The finish may be a powder coat or any other suitable coat. Corner bracket 108 may bent in different directions from the one piece of material.

Corner bracket 108 may have different faces. Each face may be bent from the one piece of material of corner bracket 108. There may be a top side face which may be topside 302. Topside 302 may be an "L" shape. The underneath of topside 302 may be placed on the corner of a tabletop. Corner bracket 108 may have a right wall face descending from the outer right edge of topside 302. The right-side wall may be right wall 304. Corner bracket 108 may have a left wall face descending from the outer right edge of topside 302. The left-side wall may be left wall 306. The walls may descend orthogonally with one another from topside 302. The orthogonal descent may result from an orthogonal bend from topside 302.

Figure 4B:
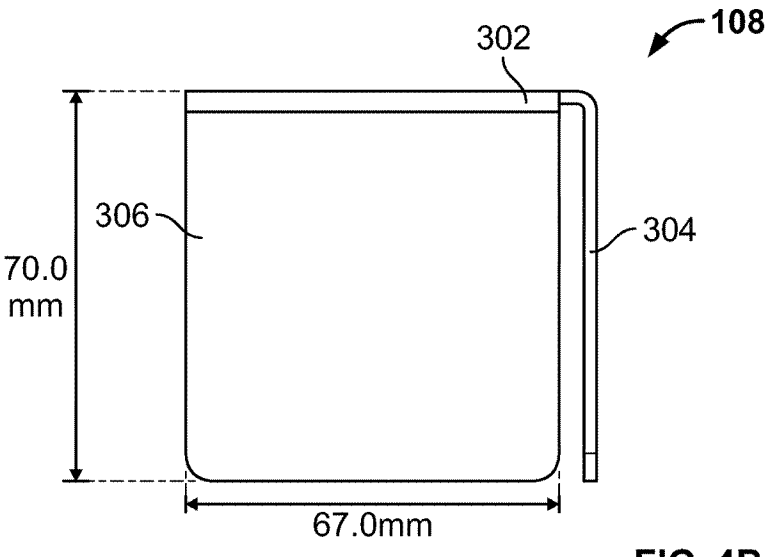
FIG. 4A-4D shows still another illustrative apparatus in accordance with principles of this matter.
Figure 4A:
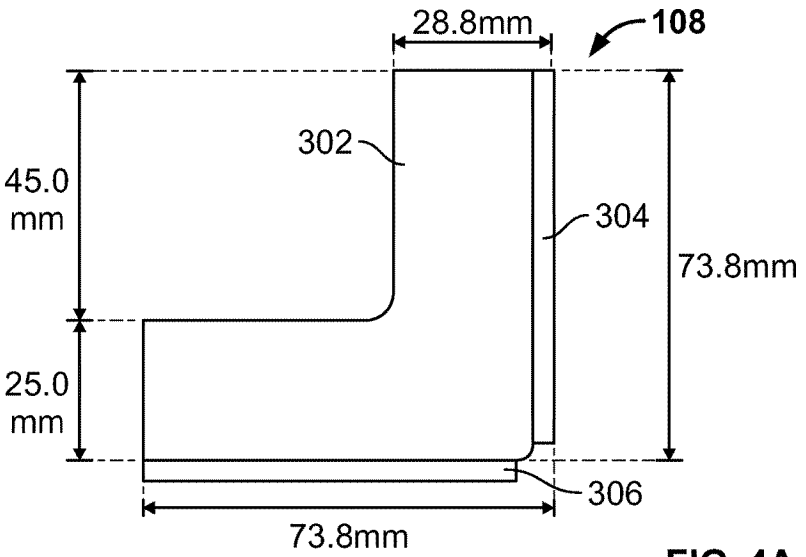

FIG. 4A shows a topside view of corner bracket 108. The topside view shows topside 302, a topside view of right wall 304 and a topside view of left wall 306. The length of left wall 306 may be on or about 73.8 millimeters or anywhere between 5% of 73.8 millimeters. The width of right wall 304 and including the top of left wall 306 may be on or about 73.8 millimeters or anywhere between 5% of 73.8 millimeters.

Right wall 304 and left wall 306 may have curved corners. The curves of the corners may be on or about 5 millimeters or anywhere between 5% of 5 millimeters.

There may be a bend from topside 302 to right wall 304 and left wall 306. The bend may be a 90° angle downward bend. The bend may be anywhere between 0 and 6 millimeters or any other suitable size. Topside 302 may be an "L" shape. The width of one of the legs of the "L" on the topside of the corner bracket may be on or about 25 millimeters or anywhere between 5% of 25 millimeters.

There may be a gap between the right wall and the left wall. The length from the end of the leg of the "L" shape until the end of the corner bracket may be on or about 45 millimeters or anywhere within 5% of 45 millimeters.

FIG. 4B shows a left-side view of corner bracket 108. The width of right wall 304 (not shown) may be on or about 67 millimeters or anywhere between 5% of 67 millimeters. The width of left wall 306 may be on or about 67 millimeters or anywhere between 5% of 67 millimeters. The height of right wall 304 and left wall 306 may be on or about 70 millimeters or anywhere between 5% of 70 millimeters.

Figure 4D:
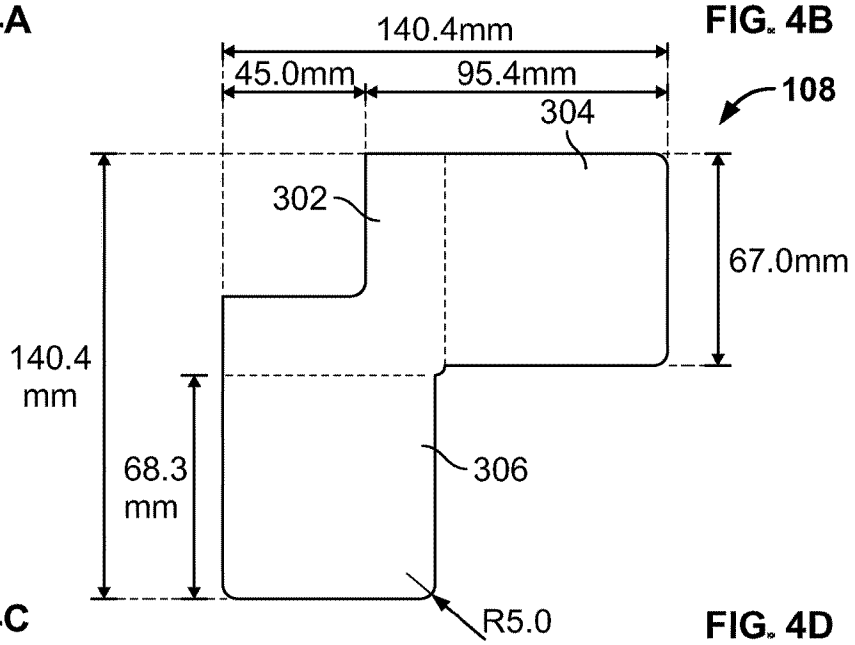
Figure 4C:
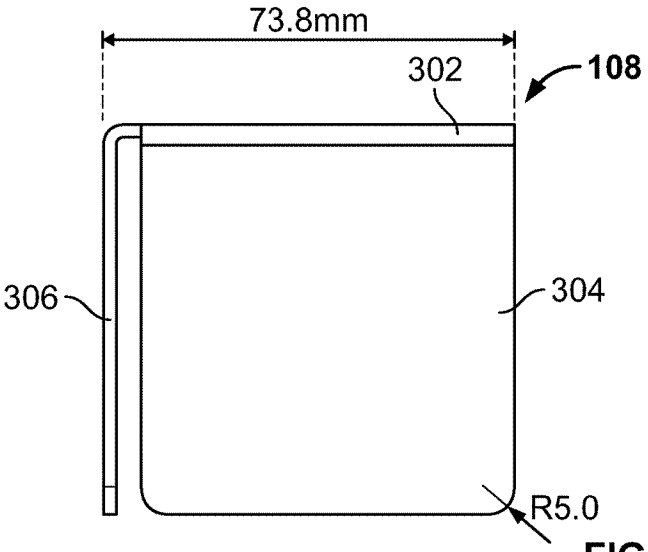

FIG. 4C shows a right-side view of corner bracket 108.

FIG. 4D shows a flat view of corner bracket 108. The flat view of corner bracket 108 may show the one piece of material of which corner bracket 108 is made. The flat view of corner bracket 108 may include corner bracket 108 not including any bends. The dotted lines on the corner bracket shown in FIG. 4D show where the bends are. There may be one or more corner brackets included in tabletop corner bracket assembly 100.

The height of the flat corner bracket may be on or about 140.4 millimeters or anywhere between 5% of 140.4 millimeters. The width of the flat corner bracket may be on or about 140.4 millimeters or anywhere between 5% of 140.4 millimeters. 95.4 millimeters may represent the width of the right side including the topside. 95.4 millimeters may also be the length of the left side including the topside. The height of the right side and the left side may be on or about 68.3 millimeters.

Right wall 304 and left wall 306 may have curved corners. The curves of the corners may be on or about 5 millimeters or anywhere between 5% of 5 millimeters.

Figure 5:
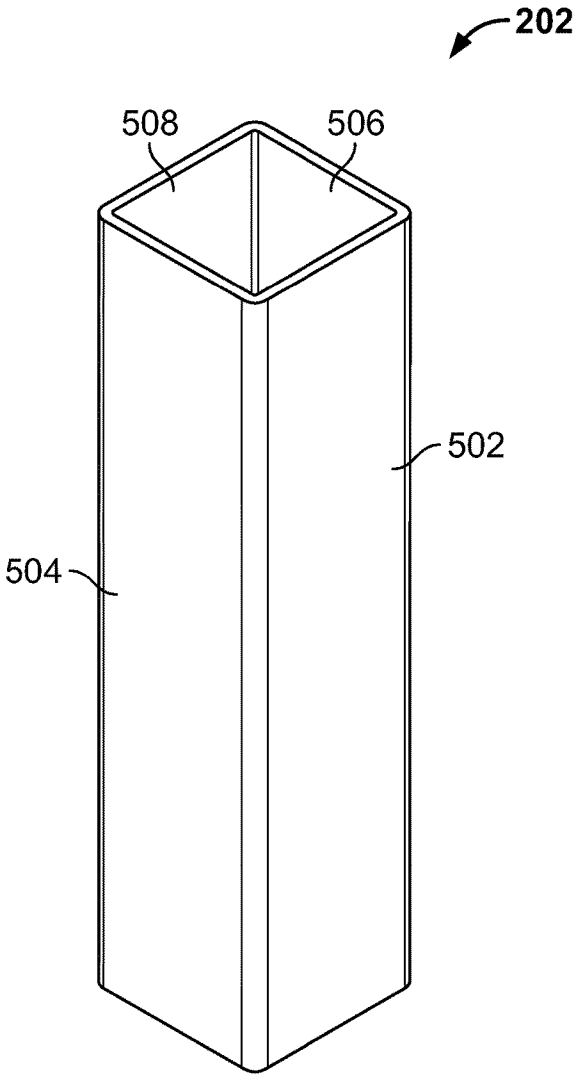
FIG. 5 shows an illustrative apparatus in accordance with principles of this matter.

FIG. 5 shows corner post 202. Corner post 202 may be a rectangular shape with a length, a width and a depth. Corner post 202 may have six sides in a 3D rectangular shape. Four of the sides may be produced from steel. The steel may be 14-gauge steel. Other gauge steel may also be used. The steel may have a powder coat and/or any other suitable coat. The height of corner post 202 may be on or about 101.6 millimeters or anywhere between 5% of 101.6 millimeters. There may be one corner post included in tabletop corner bracket assembly 100.

Corner post 202 may have a top and bottom side. The top and bottom side may be empty. The width and depth of the top and bottom sides may be on or about 25 millimeters or anywhere between 5% of 25 millimeters. There may be one or more corner posts included in tabletop corner bracket assembly 100.

There may be four sides of corner post 202. There may be sides 502, 504, 506 and 508. Sides 502 and 504 may be inner sides. Sides 506 and 508 may be the outer sides. Sides 502 and 504 may be the sides that are welded to the panel sleeves. The width of each of sides 502, 504, 506 and 508 may be on or about 25 millimeters or anywhere between 5% of 25 millimeters. The length of each of sides 502, 504, 506 and 508 may be on or about 101.6 millimeters or anywhere between 5% of 101.6 millimeters.

The bottom side may be where corner post 202 is welded to corner bracket 108. The topside may be where the post end cap is placed.

Figure 6C:
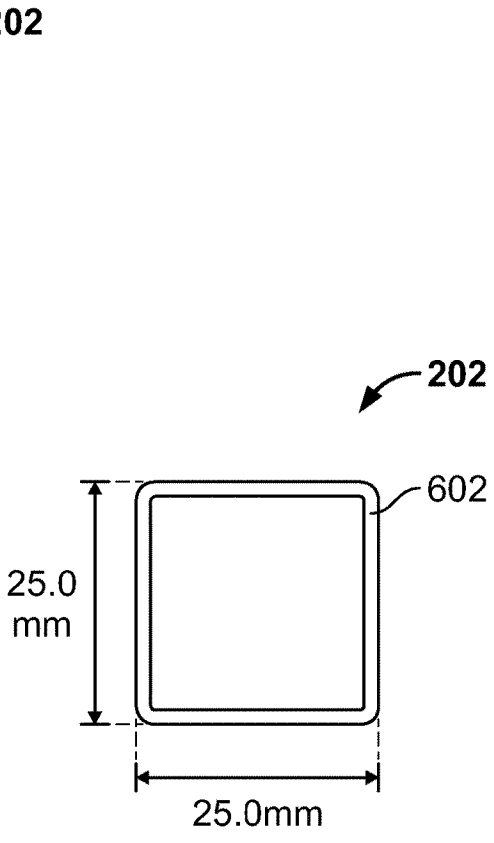
FIG. 6A-6C shows another illustrative apparatus in accordance with principles of this matter.
Figure 6B:
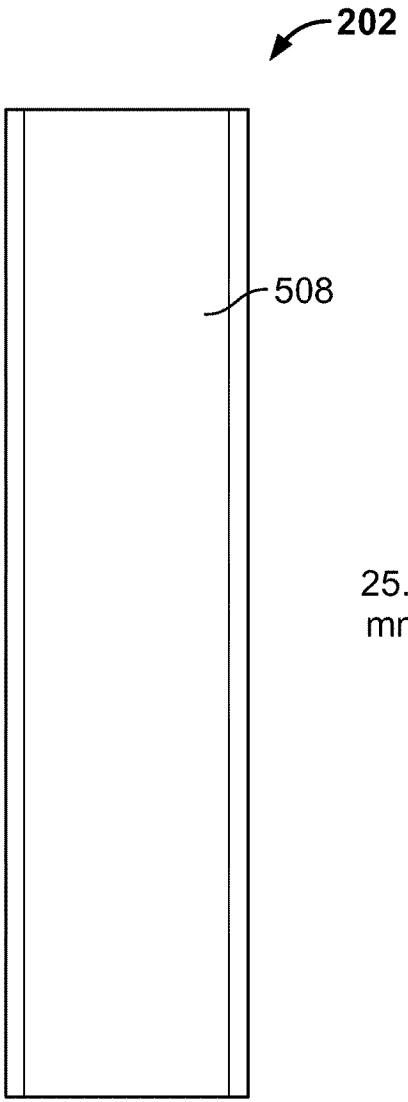
Figure 6A:
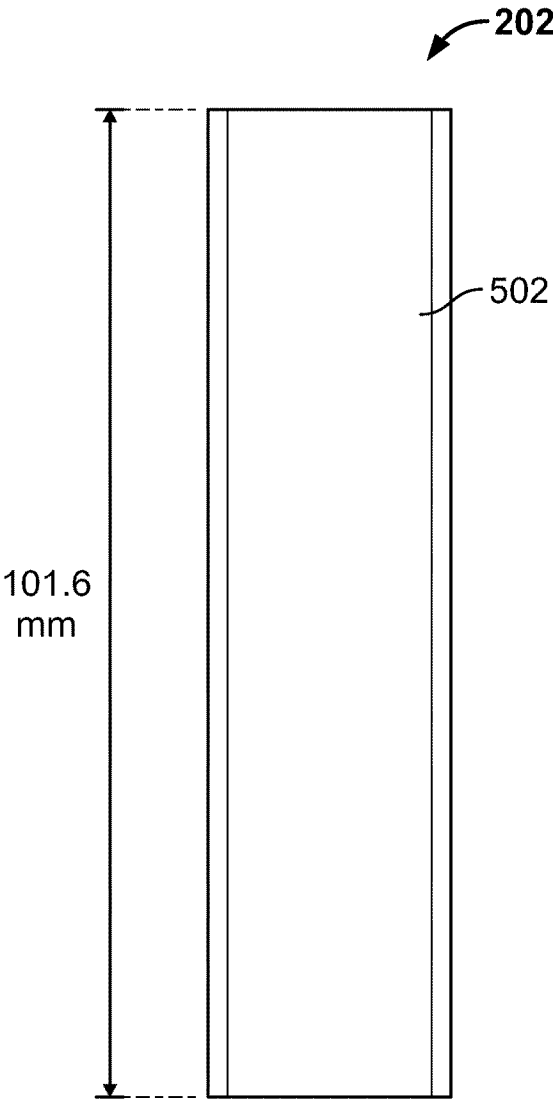

FIG. 6A shows a front view of corner post 202.

FIG. 6B shows a back view of corner post 202.

FIG. 6C shows a topside view of corner post 202. The topside of corner post 202 may be seen from the top view. The topside may be topside 602. Topside 602 may be where the post end cap is inserted. The post end cap may be stored in topside 602.

Figure 7:
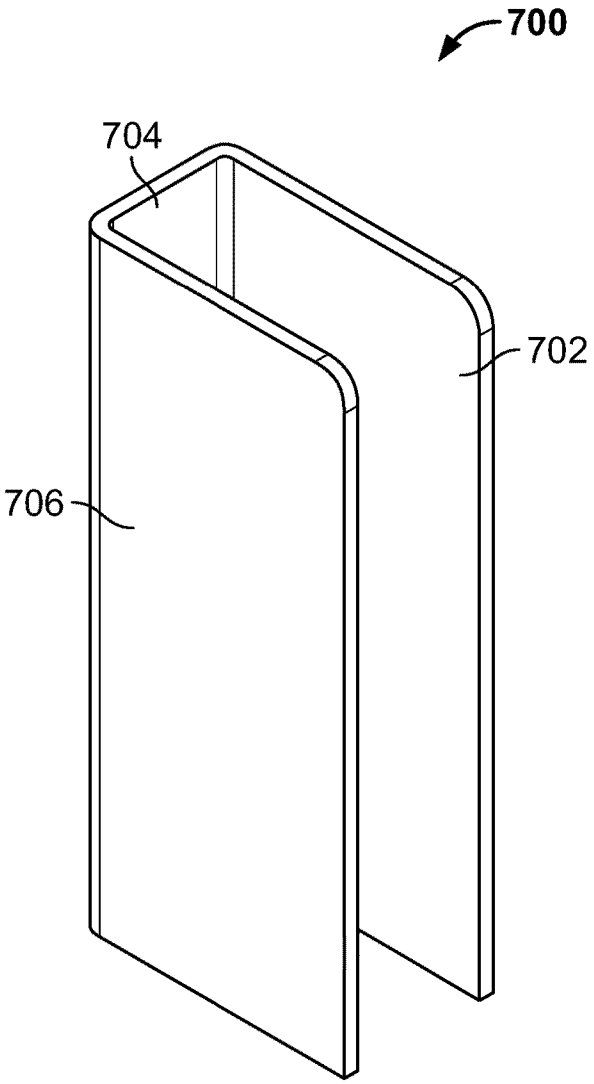
FIG. 7 shows yet another illustrative apparatus in accordance with principles of this matter.

FIG. 7 shows panel sleeve 700. Panel sleeve 700 may be panel sleeves 104 and 106 shown in FIG. 1. There may be a plurality of panel sleeves included in tabletop corner assembly bracket 100. The plurality of panel sleeves may include two panel sleeves. Panel sleeves 104 and 106 may be identical panel sleeves. Panel sleeve 700 may be made of steel. The steel that panel sleeve 700 may be made up of may be 13-gauge steel. Other gauge steel may also be used. There may be a coat on top of the steel. The coat may be a powder coat or any other suitable coat.

Panel sleeve 700 may be created from one sheet of metal. Panel sleeve 700 may be folded in two places. Panel sleeve 700 may be folded lengthwise. The two folds may create three sides each with two faces. The right side may be right side 702. Right side 702 may have an inner face and an outer face. The second side may be a closed end side. The closed end side may be closed end side 704. Closed end side 704 may include an outer face and an inner face. In one of the pluralities of panel sleeves, the outer face of the closed end side may be welded onto side 502 of corner post 202 (as shown in FIG. 5). Another of the pluralities of panel sleeves may include an outer face of closed end side 704 that may be welded onto side 504 of corner post 202 (as shown in FIG. 5). The third side may be left side 706. Left side 706 may include an outer face and an inner face.

The three inner faces of the panel sleeves may form an inner sleeve. The inner sleeve may be the location where a bumper is placed. The bumper may be part of the tabletop bumper kit.

In some embodiments, a bumper may be produced from acrylic. In the event that a bumper is acrylic, one or more foam inserts may be placed inside each inner sleeve panel sleeve. The foam inserts may be used for installation along with the acrylic bumpers.

Figure 8C:
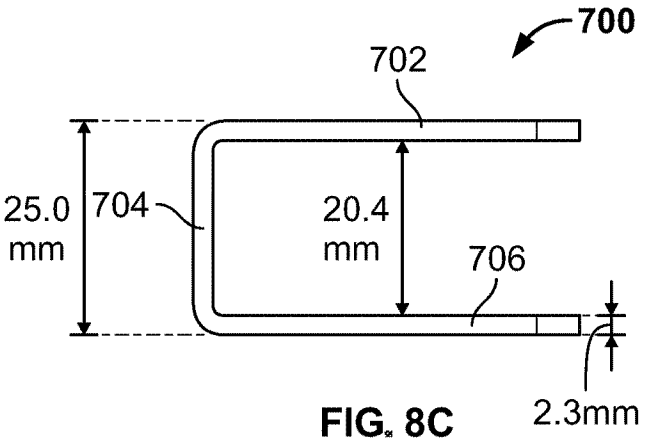
FIG. 8A-8D shows still another illustrative apparatus in accordance with principles of this matter.
Figure 8D:
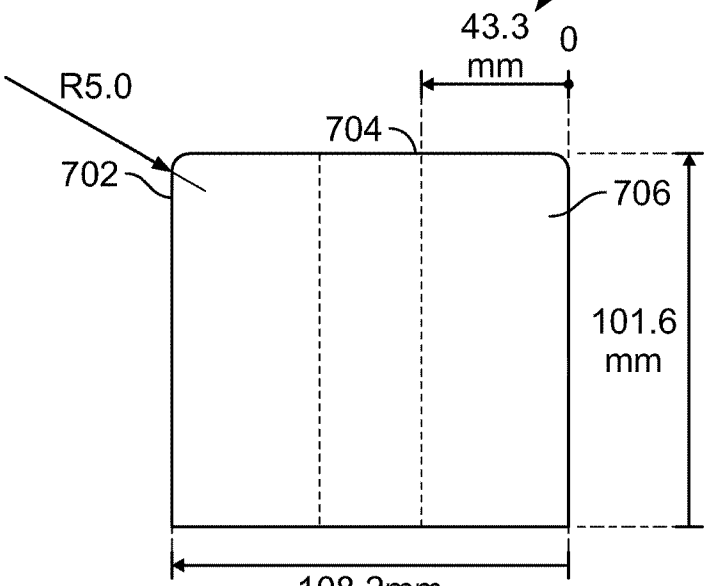
Figure 8B:
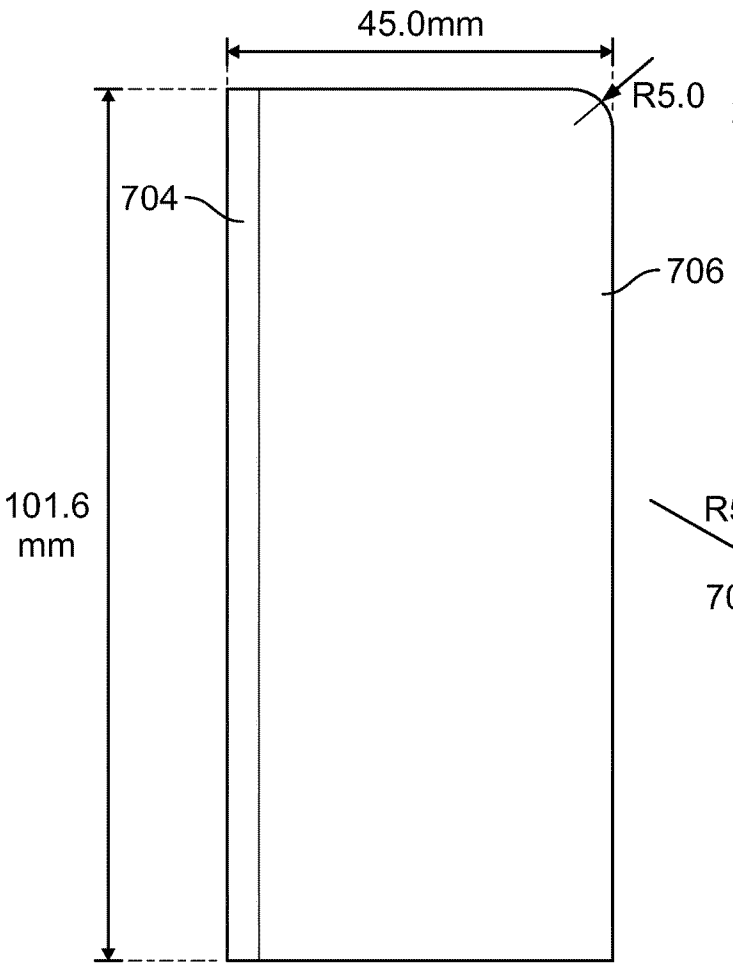
Figure 8A:
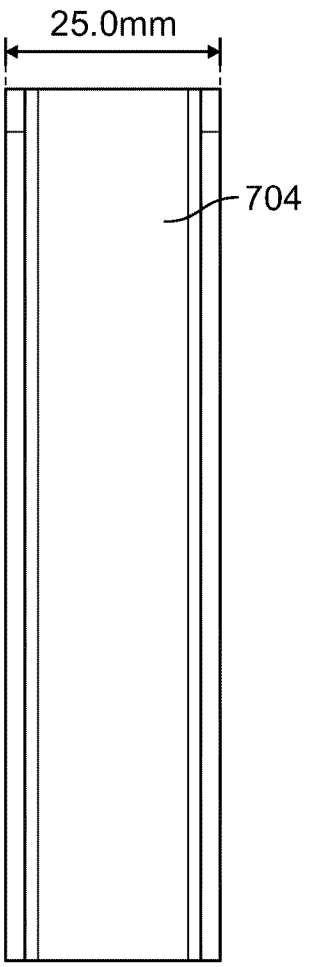

FIG. 8A shows a rear view of panel sleeve 700. The rear view shows the outer face of closed end side 704. The width of the outer face of closed end side 704 may be on or about 25 millimeters or anywhere between 5% of 25 millimeters. The height of the outer face of closed end side 704 may be on or about 101.6 millimeters or anywhere between 5% of 101.6 millimeters, as shown in FIG. 8B. The height of the outer face of the closed end side may be the same height as the rest of the sides of the panel sleeves.

FIG. 8B shows a left view of panel sleeve 700. The left view of panel sleeve 700 may show the outer face of left side 706. Left side 706 may have a curved corner. The corner may be curved on or about 5 millimeters or anywhere between 5% of 5 millimeters. The width of the outer face of left side 706 may be on or about 45 millimeters or anywhere between 5% of 45 millimeters. The measurement of the width may include the bend between closed end side 704 and left side 706. The measurement of the outer face of right side 702 may be on or about 45 millimeters or anywhere between 5% of 45 millimeters.

FIG. 8C shows a topside view of panel sleeve 700. The topside view shows a topside view of right side 702, closed end side 704 and left side 706. The measurement of the inner face of closed end side 704 may be on or about 20.4 millimeters or anywhere between 5% of 20.4 millimeters. The measurement of the thickness of the steel may be on or about 2.3 millimeters or anywhere between 5% of 2.3 millimeters.

FIG. 8D shows a flat version of panel sleeve 700. The flat version includes the piece of steel. The dotted lines on panel sleeve 700 shows where there is a bend in the panel sleeve. The width of the piece of steel when flattened measures on or about 108.2 millimeters or anywhere between 5% of 108.2 millimeters. The width of right side 706 and left side 702 may be on or about 43.3 millimeters or anywhere between 5% of 43.3 millimeters. The bends in the piece of steel are two lengthwise bends at a 90° angle. The bends may measure anywhere between 0 and 6 millimeters or any other suitable size. There may be a top and bottom of panel sleeve 700.

Figure 9:
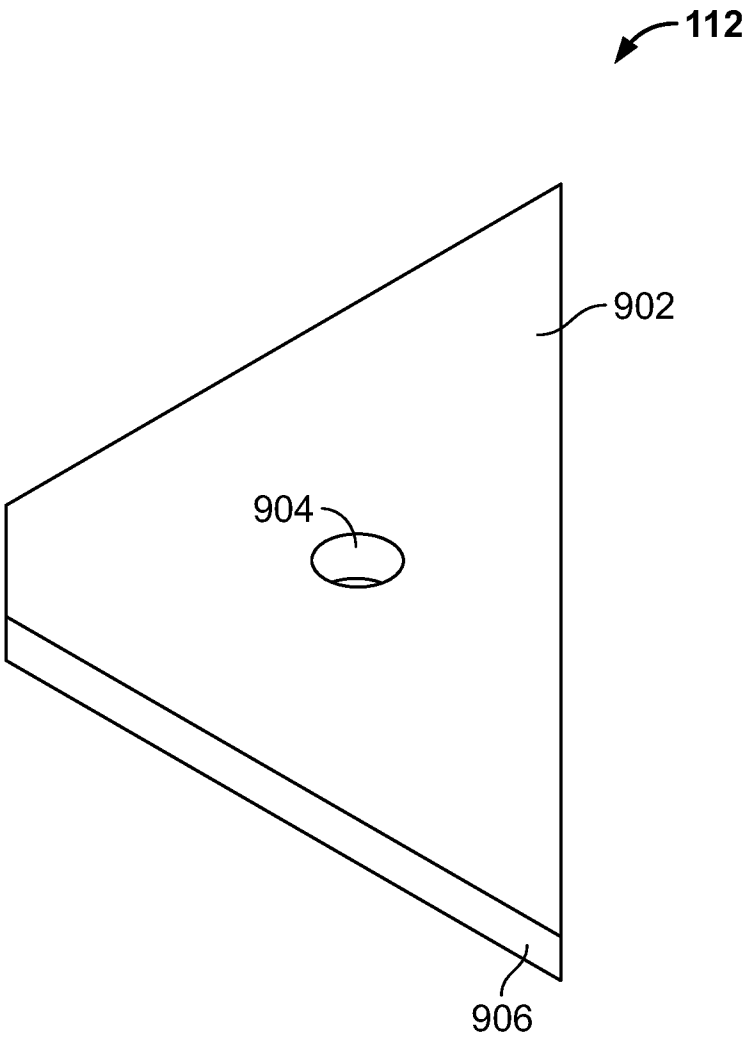
FIG. 9 shows an illustrative apparatus in accordance with principles of this matter.

FIG. 9 shows bottom flange 112. Bottom flange 112 may be made of steel. The steel that bottom flange 112 may be made of may be 9-gauge steel. Other gauge steel may also be used. Bottom flange 112 may have a coating. The coating may be a powder coat or any other suitable coat. Bottom flange 112 may be a triangular shape. There may be two sharp points. There may be a third, flat point, creating an additional edge.

There may be an aperture inside bottom flange 112. The aperture may be aperture 904. Aperture 904 may be a threaded aperture. Aperture 904 may be for placement of the pressure screw (as shown in FIG. 1). Bottom flange 112 may have topside 902. Bottom flange 112 may have edges. The edges may be edges 906. The edges may be welded onto the bottom of the corner bracket, as shown in FIG. 1, and are described in the portion of the specification corresponding thereto.

Figure 10B:
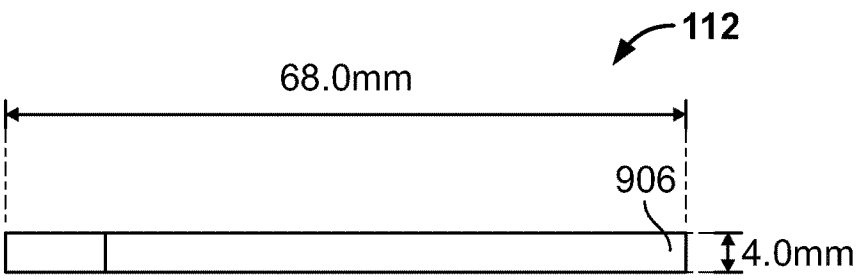
FIG. 10A-10B shows another illustrative apparatus in accordance with principles of this matter.
Figure 10A:
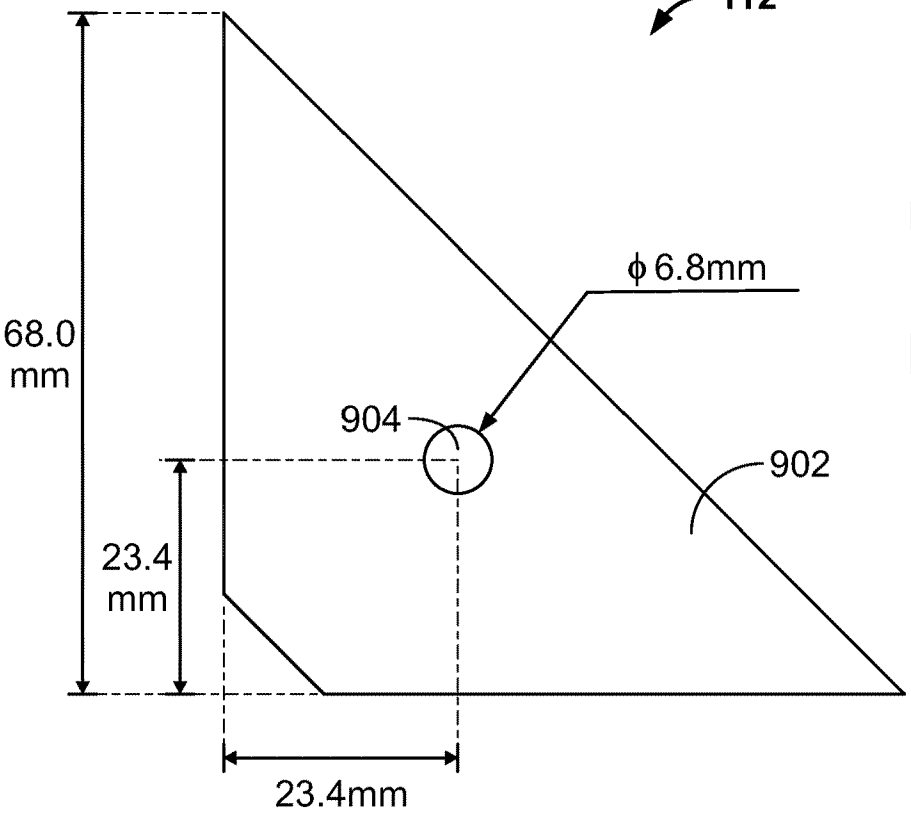

FIG. 10A shows a topside view of bottom flange 112. The topside view includes a topside view of aperture 904. Aperture 904 may be on or about 6.8 millimeters or anywhere between 5% of 6.8 millimeters in diameter. Aperture 904 may be located on or about 23.4 millimeters or anywhere between 5% of 23.4 millimeters into topside 902.

FIG. 10B shows a side view of bottom flange 112. Side view of bottom flange 112 shows the thickness of the steel. The thickness of the steel may be the height of edges 906. The thickness of the steel and the height of the edges may be on or about 4 millimeters or anywhere between 5% of 4 millimeters thick. The length of topside 902 may be on or about 68 millimeters or anywhere between 5% of 68 millimeters.

Figure 11:
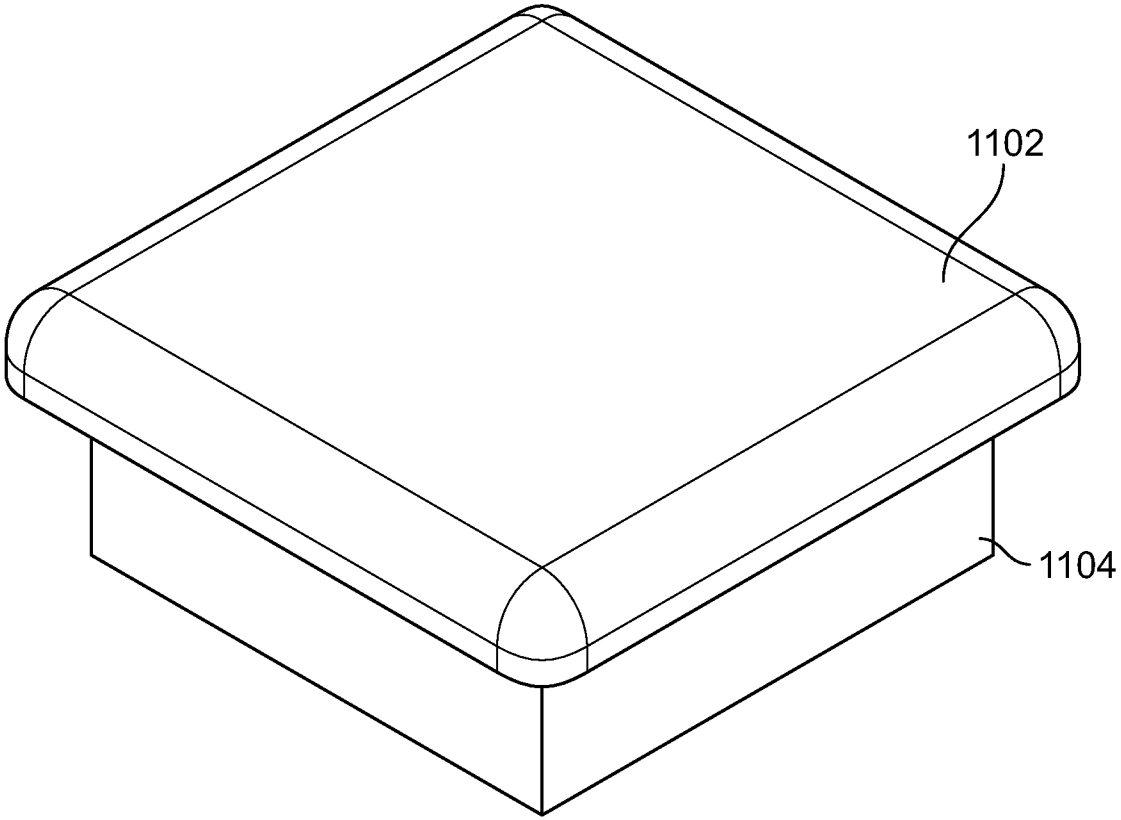
FIG. 11 shows yet another illustrative apparatus in accordance with principles of this matter.

FIG. 11 shows post end cap 102. Post end cap 102 may be produced from material. The material that post end cap 102 may be produced from may be plastic. Post end cap 102 may fit into the top of the corner post securely. A ribbing may ensure that the post end cap is securely fit into the corner post. This can be ensured in other suitable ways as well.

Post end cap 102 may have two or more parts. One part may be top part 1102. Top part 1102 may be for covering the top of the corner post, including the outer layers. An additional part of post end cap 102 may be bottom part 1104. Bottom part 1104 may be slightly smaller than top part 1102. Bottom part 1104 may sit right inside the top side of the corner post.

Figure 12B:
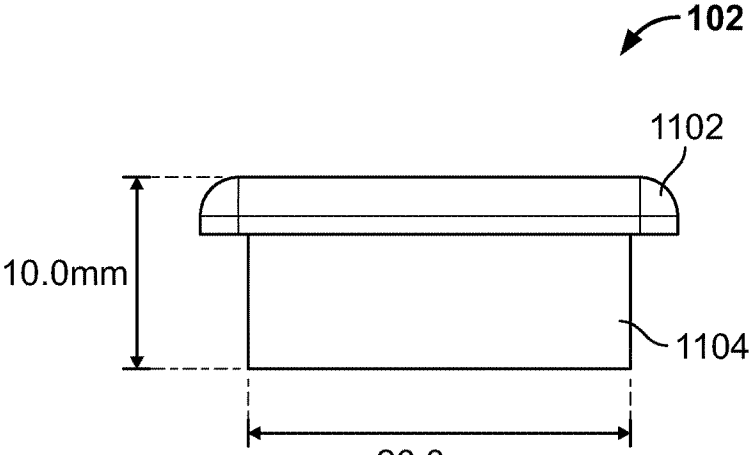
FIG. 12A-12C shows still another illustrative apparatus in accordance with principles of this matter.
Figure 12C:
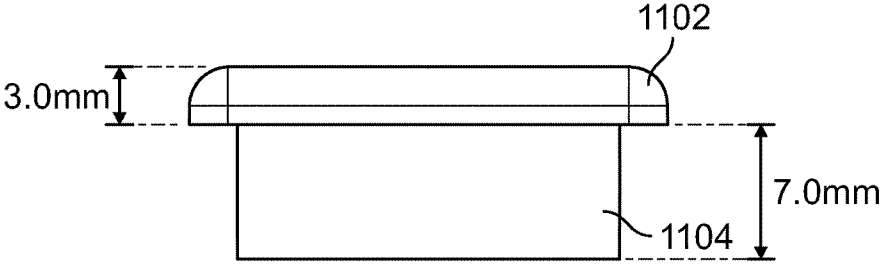
Figure 12A:
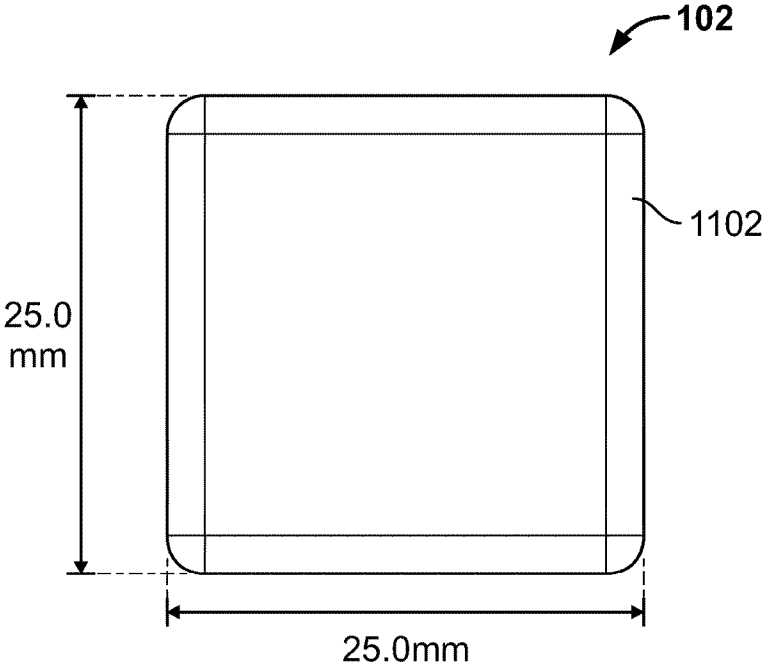

FIG. 12A shows a top view of post end cap 102. The top view shows the top of top part 1102. Top part 1102 may be on or about 25 millimeters or anywhere between 5% of 25 millimeters in length and width.

FIG. 12B shows a right-side view of post end cap 102. The right-side view of post end cap 102 shows a right-side view of top part 1102 and bottom part 1104. The height of the post end cap may be on or about 10 millimeters or anywhere between 5% of 10 millimeters. The width of bottom part 1104 may be on or about 20 millimeters or anywhere between 5% of 20 millimeters. There may be ribbing along the outer sides of bottom part 1104.

FIG. 12C shows a left side view of post end cap 102. The height of bottom part 1104 may be on or about 7 millimeters or anywhere between 5% of 7 millimeters. The height of top part 1102 may be on or about 3 millimeters or anywhere between 5% of 3 millimeters.

Figure 13C:
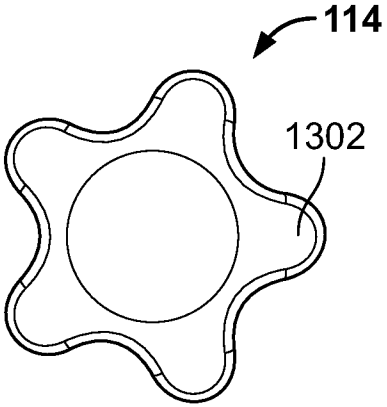
FIG. 13A-13C shows an illustrative apparatus in accordance with principles of this matter.
Figure 13B:
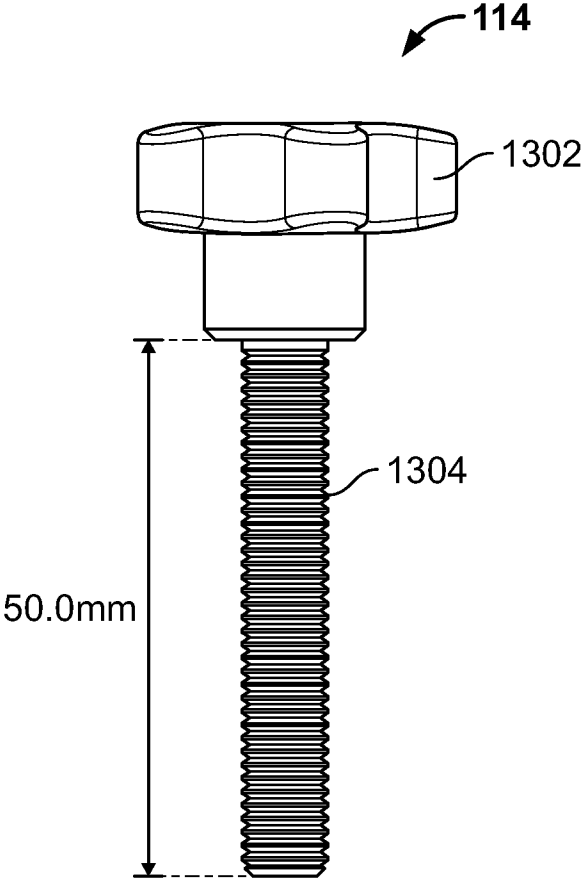
Figure 13A:
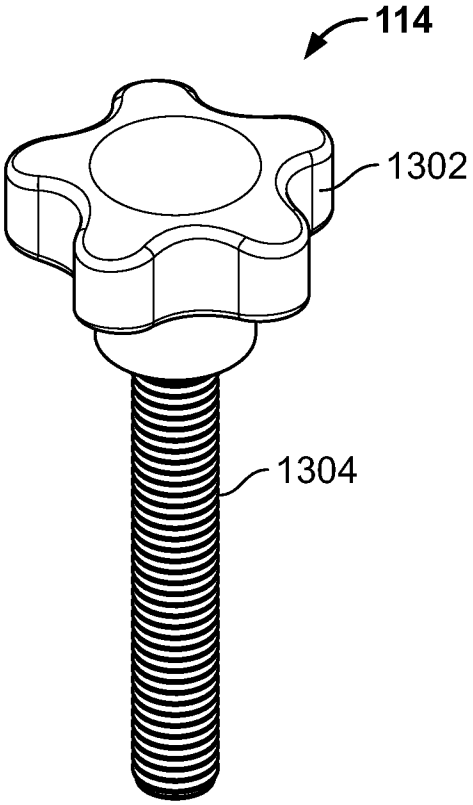

FIG. 13A shows pressure screw 114. Pressure screw 114 may be shown in an upward position. Pressure screw 114 may be used in an upside-down position with the tabletop corner bracket assembly. Pressure screw 114 includes head 1302. Pressure screw 114 may include a male thread. The male thread may be thread 1304. Thread 1304 and head 1302 may make up pressure screw 114.

FIG. 13B shows a front view of pressure screw 114. The height of thread 1304 may be on or about 50 millimeters or anywhere between 5% of 50 millimeters. The width of thread 1304 may be on or about 1.25 millimeters or anywhere between 5% of 1.25 millimeters. Pressure screw 114 may be formed at least in part from steel or any other suitable material.

FIG. 13C shows a top view of pressure screw 114. The top view shows the top of head 1302. Head 1302 may be a smooth surface. Head 1302 may not have a thread. Head 1302 may not have a thread because this may ease fastening the tabletop corner bracket assembly onto a tabletop.

Figure 14:
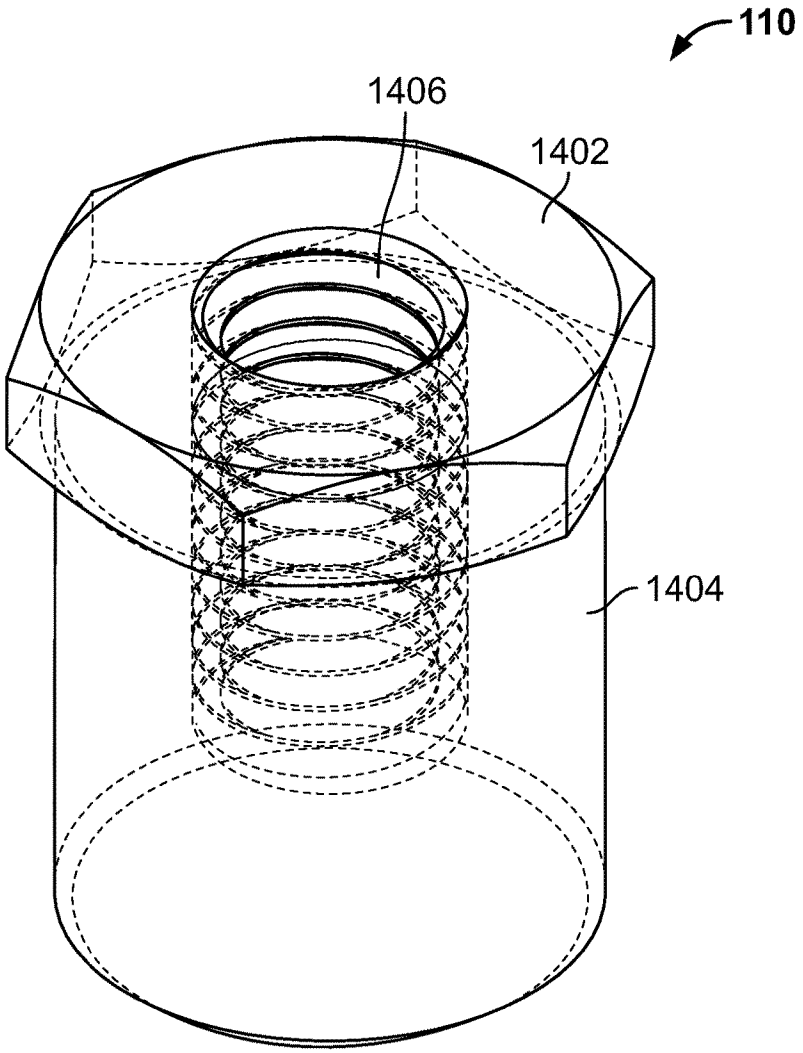
FIG. 14 shows another illustrative apparatus in accordance with principles of this matter.
Figure 15B:
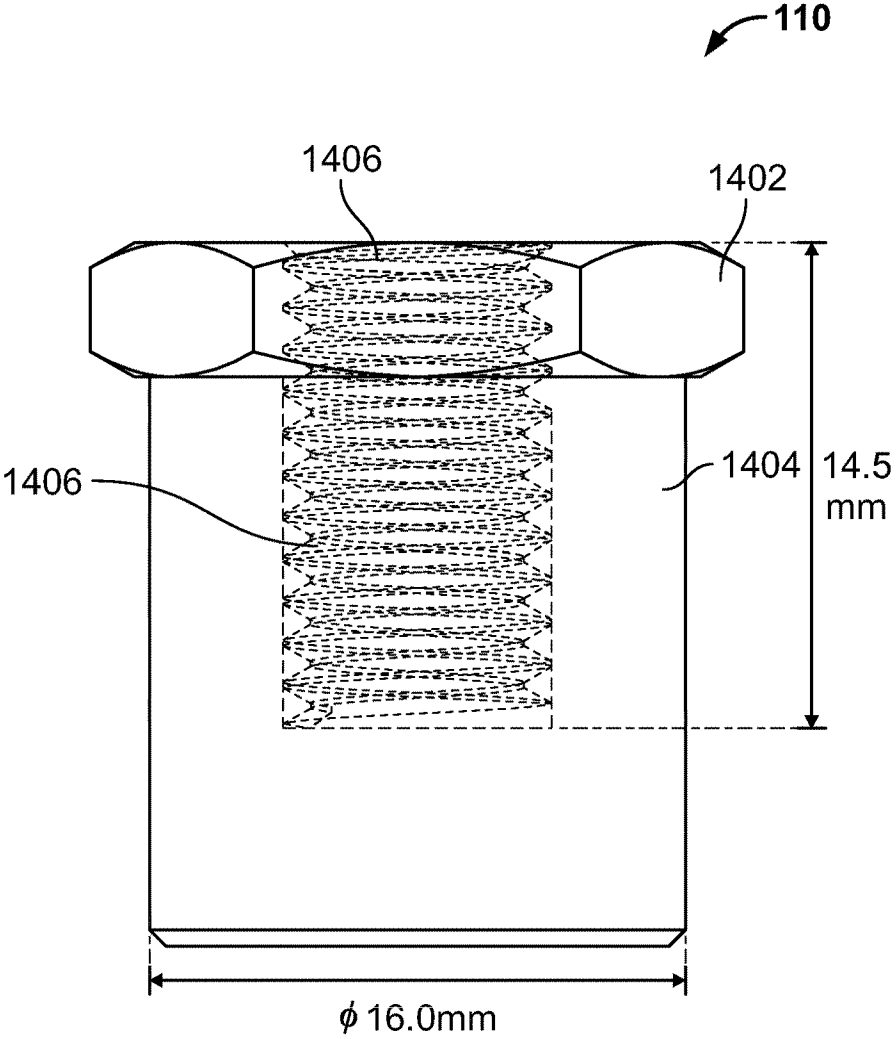
FIG. 15A-15B shows yet another illustrative apparatus in accordance with principles of this matter.

FIG. 14 shows clamp end 110. Clamp end 110 may be made of steel. Clamp end 110 may have a top part. The top part may be 1402. Top part 1402 may be of a hexagon shape. Clamp end 110 may have a bottom part. Bottom part may be 1404. Bottom part 1404 may be a cylindrical shape. Clamp end 110 may have a cavity. The cavity may be cavity 1406. Cavity 1406 may be a threaded cavity. The cavity may begin in the center of 1402 and may continue down on or about 14.5 millimeters or anywhere between 5% of 14.5 millimeters into 1404, as shown in FIG. 15B.

Clamp end 110 may be designed to be screwed onto pressure screw 114. Pressure screw 114 may be screwed into clamp end 110 after it is screwed through aperture 904. Clamp end 110 may ensure the security of pressure screw 114 in the aperture. Clamp end 110 may also assist in providing the adjustable clamp.

The adjustable clamp may be formed from pressure screw 114, aperture 904 in bottom flange 112, clamp end 110 and corner bracket 108. Corner bracket 108 has a topside that may rest on a tabletop, as shown in FIGS. 1-4D and are described in the portion of the specification corresponding thereto.

Upon placement of corner bracket 108 onto the tabletop, pressure screw 114, already screwed through aperture 904, can be fastened onto a bottom side of the tabletop. Pressure screw 114 along with clamp end 110 may be fastened until clamp end 110 is securely clamping the bottom side of the tabletop. The fastening of the pressure screw and clamp end on the bottom side of the tabletop and the corner bracket on the topside of a tabletop, may complete the adjustable clamp.

Figure 15A:
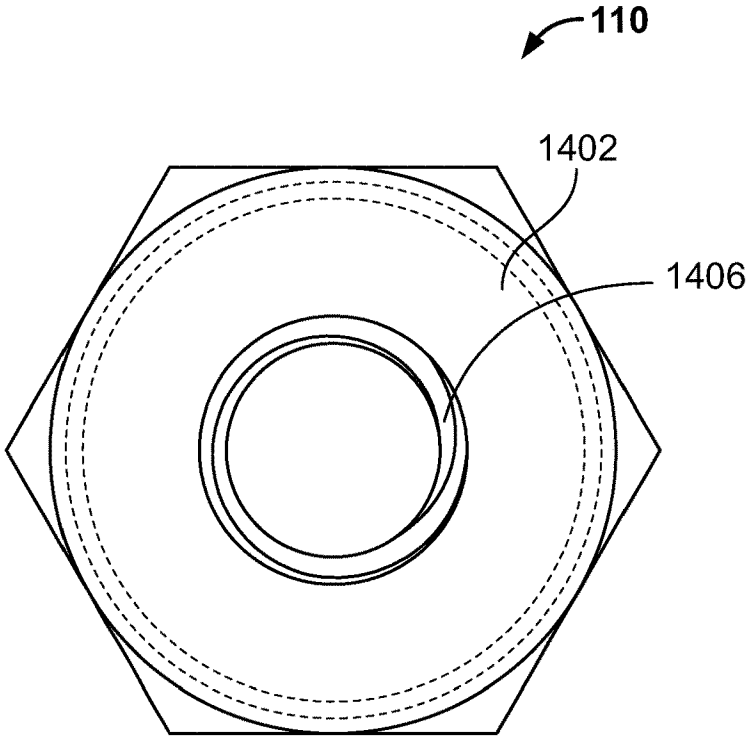

FIG. 15A shows a top side view of clamp end 110.

FIG. 15B shows a side view of clamp end 110. Clamp end 110 may be on or about 21 millimeters or anywhere between 5% of 21 millimeters in height. Clamp end 110 may be on or about 16 millimeters or anywhere between 5% of 16 millimeters in diameter.

Figure 16:
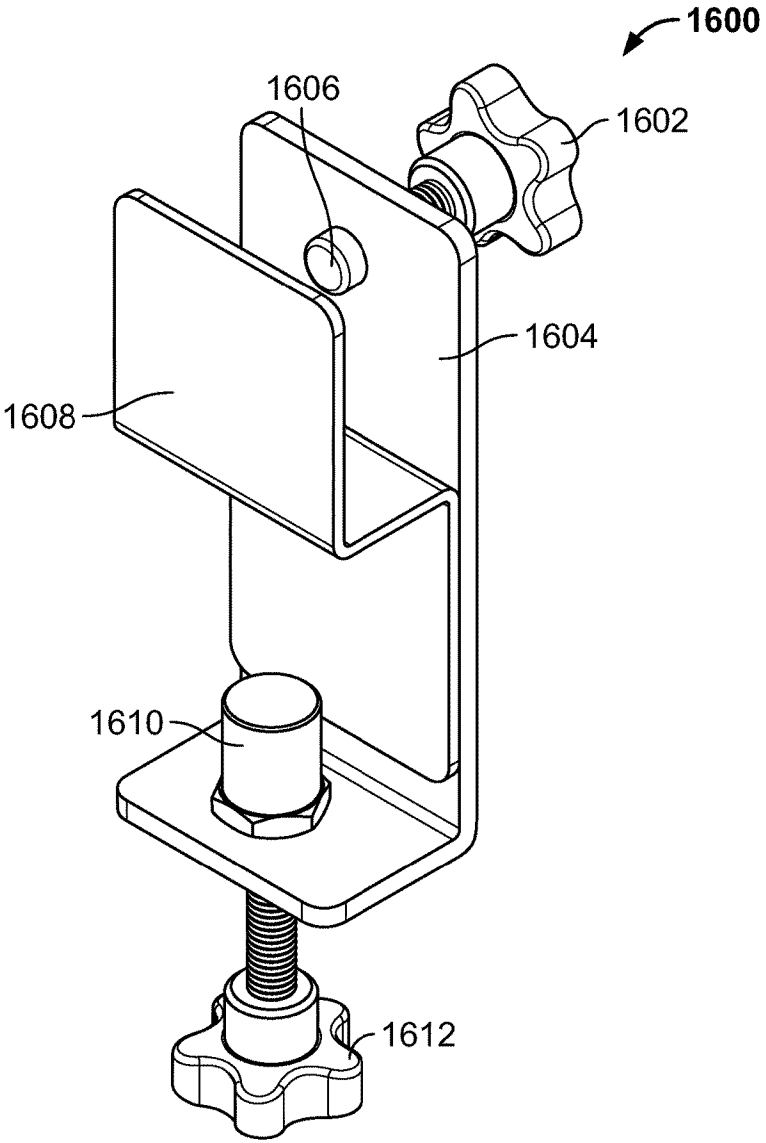
FIG. 16 shows still another illustrative apparatus in accordance with principles of this matter.

FIG. 16 shows side support bracket 1600. Side support bracket 1600 may be a side support bracket that can attach to a tabletop. Side support bracket 1600 may be included in the tabletop bumper kit. There may be a plurality of side support brackets included in the tabletop bumper kit. The plurality of side support brackets may include four or more side support brackets. Each of the side support brackets may attach to a side of a tabletop to form a tabletop bumper kit.

Side support bracket 1600 may include components 1602, 1604, 1606, 1608, 1610, 1612 and/other components. The components of side support bracket 1600 may contribute to attaching side support bracket 1600 to a side of a tabletop.

Figures 17A, 17B, 17C:
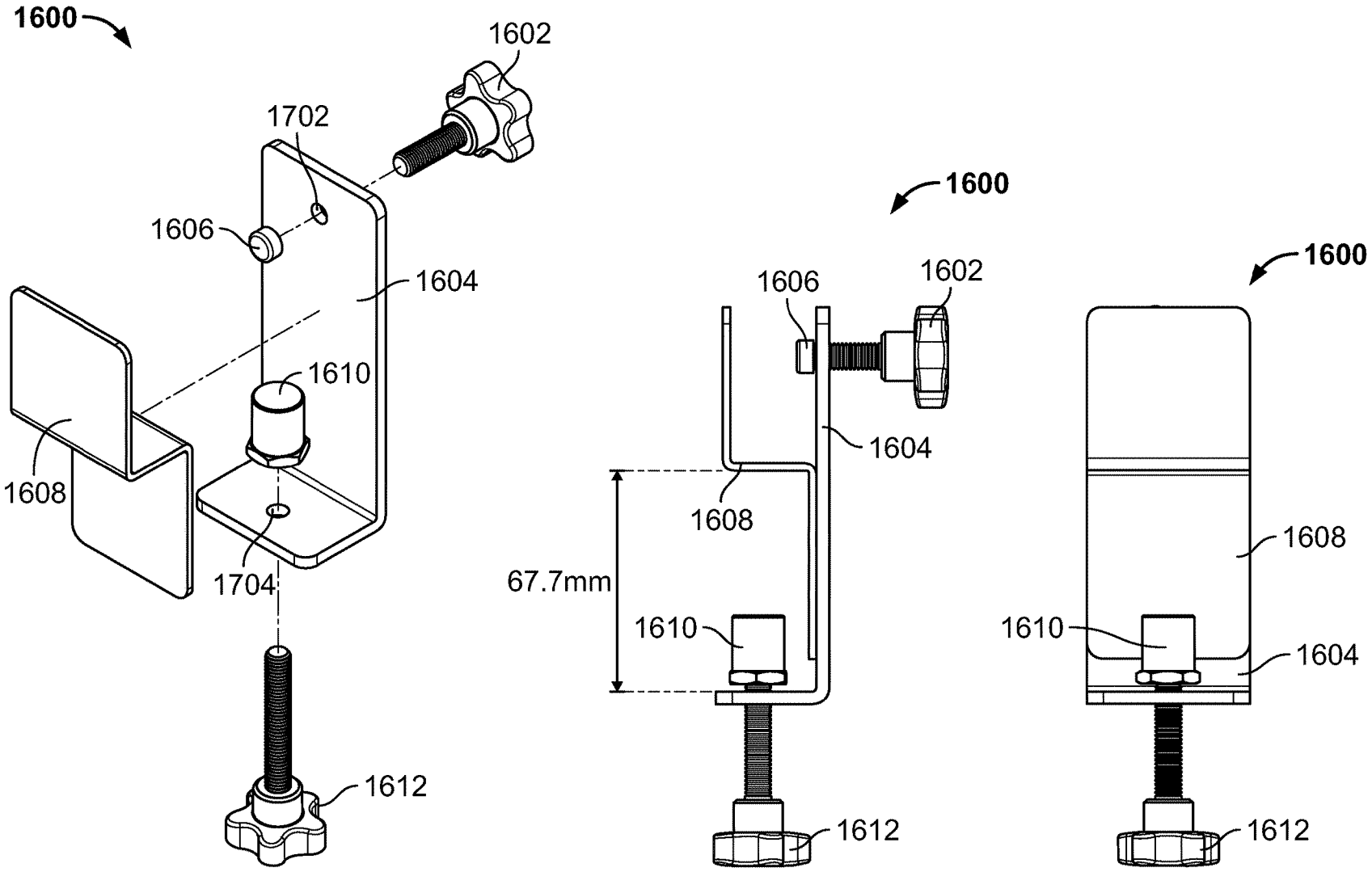
FIG. 17A-17C shows an illustrative apparatus in accordance with principles of this matter.

FIG. 17A shows a view and assembly of the components of side support bracket 1600. Side support bracket 1600 includes top pressure screw 1602, side bracket clamp flange 1604, rubber tip 1606, side bracket 1608, clamp end 1610, bottom pressure screw 1612, aperture 1702 and aperture 1704.

Side bracket clamp flange 1604 may include two sides. The two sides side bracket clamp flange 1604 may include a standing side and a platform. Side bracket clamp flange 1604 may include two apertures. These apertures may be aperture 1702 and aperture 1704. Aperture 1702 may be a threaded aperture for placement of pressure screw 1602. Aperture 1704 may be a threaded aperture for placement of pressure screw 1612. Pressure screw 1602 may be screwed into rubber tip 1606. Pressure screw 1612 may be screwed into clamp end 1610.

Side bracket 1608 may have three sides. The three sides may include an upper outer side, a middle platform and a bottom inner side. Bottom inner side of side bracket 1608 may be welded onto side bracket clamp flange 1604. The dotted line in FIG. 17A shows where the welding occurs. The welding of side bracket 1608 to side bracket clamp flange 1604 may assist in producing two adjustable clamps. Side bracket 1608 may be welded to side bracket clamp flange 1604 at a distance of on or about 67.7 millimeters from the platform.

Pressure screw 1602 may be threaded through aperture 1702. Pressure screw 1602 may be screwed into rubber tip 1606 to produce an adjustable clamp. A bumper that may or may not be included in the tabletop bumper kit may slide into side support bracket 1600. The bumper may rest on the middle platform of side bracket 1608. Pressure screw 1602 along with the rest of the adjustable clamp may be screwed to securely fasten side support bracket 1600 to the bumper.

Pressure screw 1612 may be threaded through aperture 1704 and screwed into clamp end 1610 to produce a second adjustable clamp. Side support bracket 1600 may be placed on a side of the tabletop. The bottom side of the middle platform of side bracket 1608 may be where side support bracket 1600 rests on the tabletop. Pressure screw 1612 along with the second adjustable clamp may be screwed to securely fasten to the bottom side of the tabletop. The second adjustable clamp may clamp to any suitable thickness, with an exception being the tabletop does not have a thickness greater than 3 inches.

FIG. 17B is a side view of side support bracket 1600.

FIG. 17C is a front view of side support bracket 1600.

Figure 18:
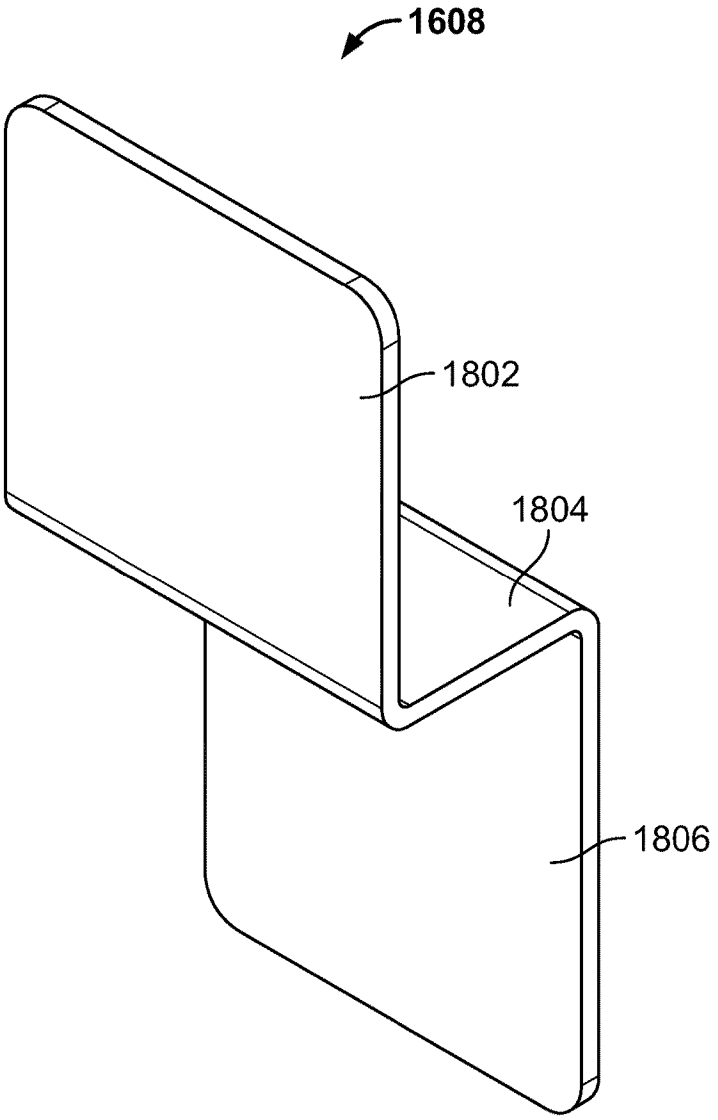
FIG. 18 shows another illustrative apparatus in accordance with principles of this matter.

FIG. 18 shows side bracket 1608. Side bracket 1608 made be made from steel. The steel that side bracket 1608 may be made from 13-gauge steel. Other gauge steel may also be used. Side bracket 1608 may have a coating. The coating may be a powder coat or any other suitable coat. Side bracket 1608 may be formed from one sheet of metal. Side bracket 1608 may have two vertical bends. The two vertical bends may create the three sides. The three sides may be an outer top side, a middle platform and a bottom inner side.

The outer top side may be outer top side 1802. Outer top side 1802 may have an inner face and an outer face. The middle platform may be middle platform 1804. Middle platform 1804 may have a top face and a bottom face. The bottom inner side may be bottom inner side 1806. Bottom inner side 1806 may have an outer face and an inner face.

Figures 19A, 19B, 19C:
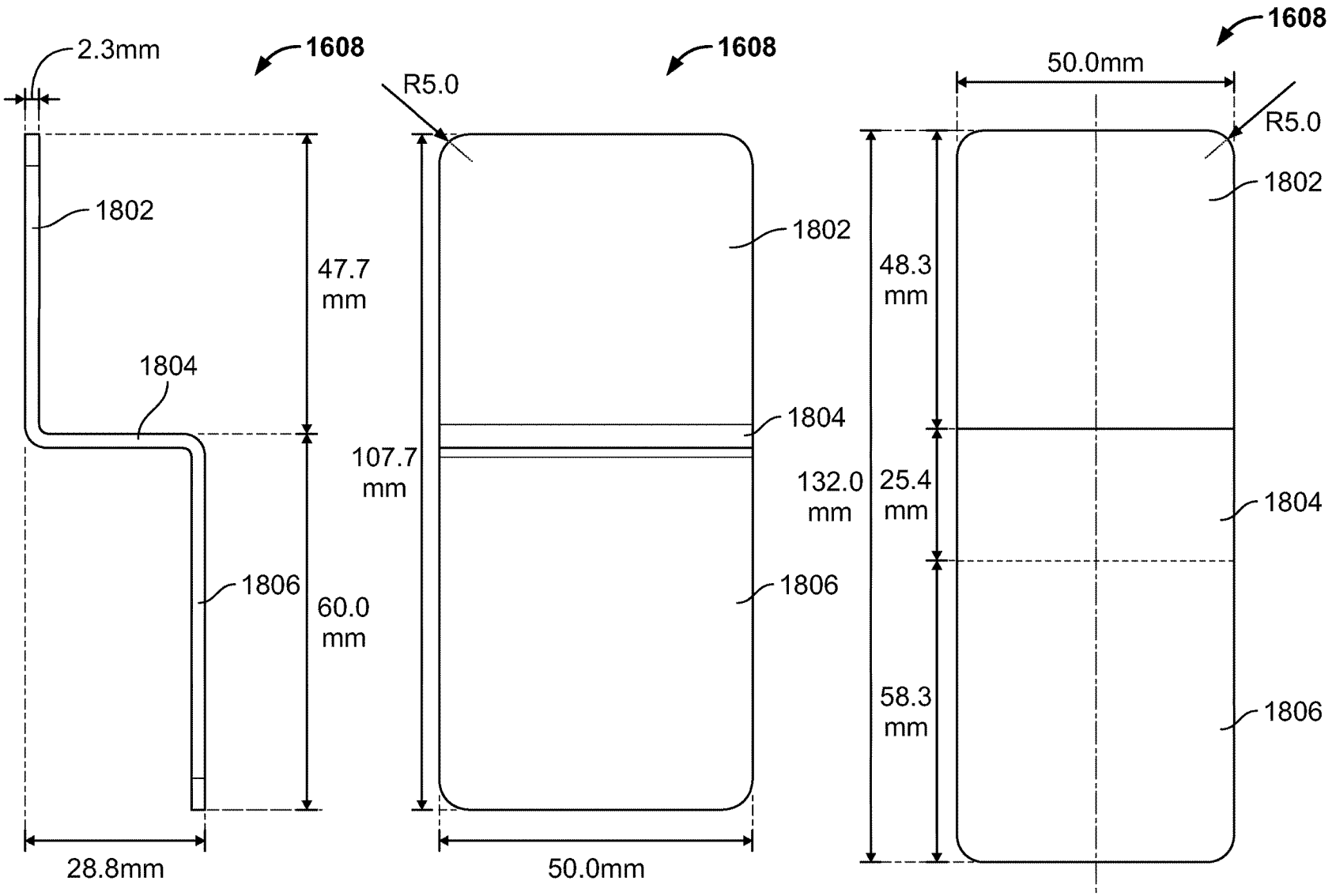
FIG. 19A-19C shows yet another illustrative apparatus in accordance with principles of this matter.

FIG. 19A shows a side view of side bracket 1608. The width of the side bracket from a side angle, which may be the depth from a front angle, may be on or about 28.8 millimeters or anywhere between 5% of 28.8 millimeters. The height of bottom inner side 1806 may be on or about 60 millimeters or anywhere between 5% of 60 millimeters. The height of outer top side 1802 may be on or about 47.7 millimeters or anywhere between 5% of 47.7 millimeters. The thickness of the steel may be on or about 2.3 millimeters or anywhere between 5% of 2.3 millimeters.

FIG. 19B shows a front view of side bracket 1608. The height of side bracket 1608, when the bracket is folded, may be on or about 107.7 millimeters or anywhere between 5% of 107.7 millimeters. The width of side bracket 1608 may be on or about 50 millimeters or anywhere between 5% of 50 millimeters. There may be four corners included in side bracket 1608. The four corners may be curved corners. The curve of the corners may be on or about 5-millimeter curve or anywhere between 5% of 5 millimeters.

FIG. 19C shows a flat view of side bracket 1608. Side bracket 1608 may be formed from one piece of steel. The one piece of steel may be in a step shape with two bends. The first vertical bend may be bent on or about 48.3 millimeters or anywhere between 5% of 48.3 millimeters from the top of the side bracket. The first bend may form outer top side 1802. The first bend is shown by a straight line found on side bracket 1608. There may be a second bend. The second bend may be on or about 58.3 millimeters or anywhere between 5% of 58.3 millimeters from the bottom of the side bracket. The second bend may form bottom inner side 1806. The second bend is shown by a dotted line found on side bracket 1608. The first bend and the second may form together middle platform 1804. Middle platform 1804 may be on or about 25.4 millimeters or anywhere between 5% of 25.4 millimeters. The length of side bracket 1608, when flattened out, may be on or about 132 millimeters or anywhere between 5% of 132 millimeters.

Figure 20:
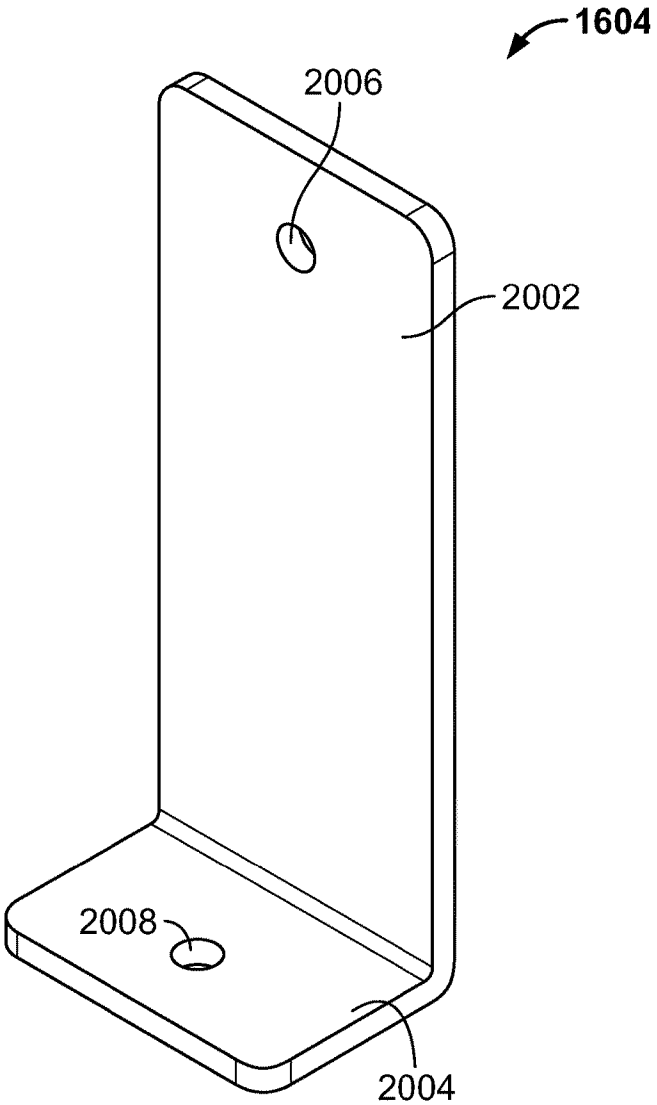
FIG. 20 shows still another illustrative apparatus in accordance with principles of this matter.

FIG. 20 shows side bracket clamp flange 1604. Side bracket clamp flange 1604 may be formed from one piece of steel. The steel may be 9-gauge steel. Other gauge steel may also be used. Side bracket clamp flange 1604 may have a coating. The coating may be a powder coat or any other suitable coat. Side bracket clamp flange 1604 may have two sides. One side may be a standing side. The standing side may be standing side 2002. Standing side 2002 may have an inner face and an outer face. The second side may be a platform. The platform may be platform 2004. Platform 2004 may have a top side and a bottom side. There may be a bend in the steel to create the two sides.

There may be an aperture in standing side 2002. The aperture may be aperture 2006. Aperture 2006 may directly relate to aperture 1702 shown in FIG. 17A and described in the portion of the specification corresponding thereto. Aperture 2006 may be a threaded aperture. Aperture 2006 may be an aperture that can hold a pressure screw. Aperture 2006 may be on or about 6.8 millimeters or anywhere between 5% of 6.8 millimeters in diameter.

There may be an aperture in platform 2004. The aperture may be aperture 2008. Aperture 2008 may directly relate to aperture 1704 shown in FIG. 17A, and are described in the portion of the specification corresponding thereto. Aperture 2008 may be a threaded aperture. Aperture 2008 may be an aperture that can hold a screw. Aperture 2008 may be on or about 6.8 millimeters or anywhere between 5% of 6.8 millimeters in diameter.

Figure 21B:
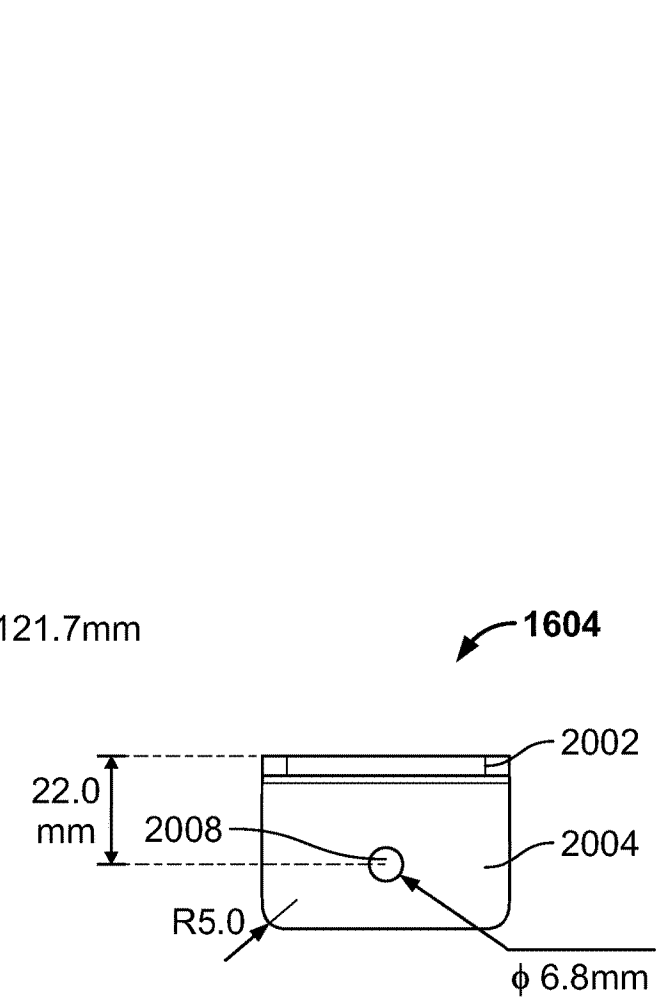
FIG. 21A-21D shows an illustrative apparatus in accordance with principles of this matter.
Figure 21A:
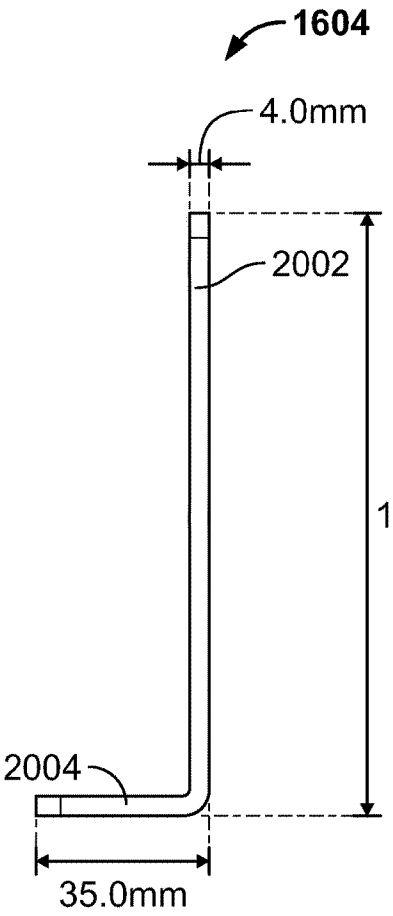

FIG. 21A is a side view of side bracket clamp flange 1604. Side bracket clamp flange 1604, from the bottom face of platform 2004 until the top of standing side 2002, may be on or about 121.7 millimeters or anywhere between 5% of 10 millimeters. The width of side bracket clamp flange 1604 may be on or about 35 millimeters or anywhere between 5% of 35 millimeters. The thickness of the steel may be on or about 4 millimeters or anywhere between 5% of 4 millimeters.

FIG. 21B is a bottom view of side bracket clamp flange 1604. The bottom view of side bracket clamp flange 1604 may show the bottom face of platform 2004. The bottom view of side bracket clamp flange 1604 may also show aperture 2008. Aperture 2008 may have a diameter of on or about 6.8 millimeters. Aperture 2008 may be on or about 22 millimeters or anywhere between 5% of 22 millimeters from a beginning of standing side 2002. Aperture 2008 may be on or about 13 millimeters or anywhere between 5% of 13 millimeters from a bottom of platform 2004. Platform 2004 may have a height, as seen from the bottom view and shown in FIG. 21D, of on or about 32.2 millimeters or anywhere between 5% of 32.2 millimeters.

Figure 21D:
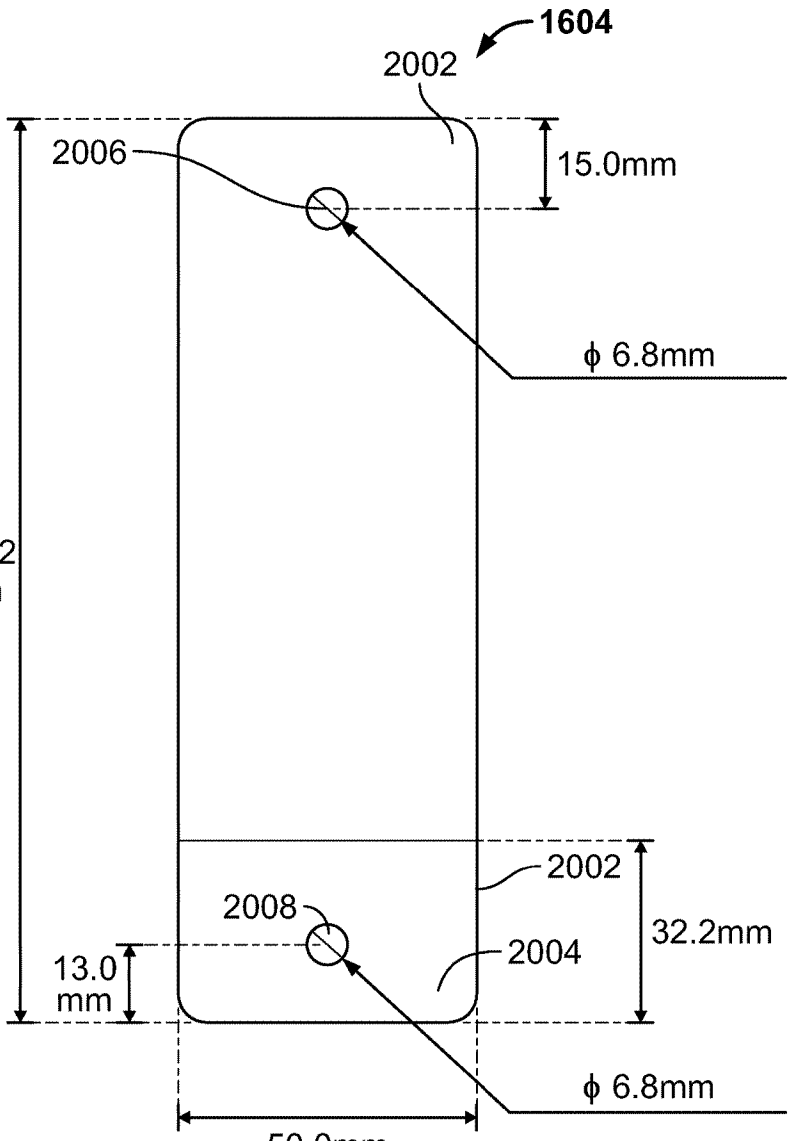
Figure 21C:
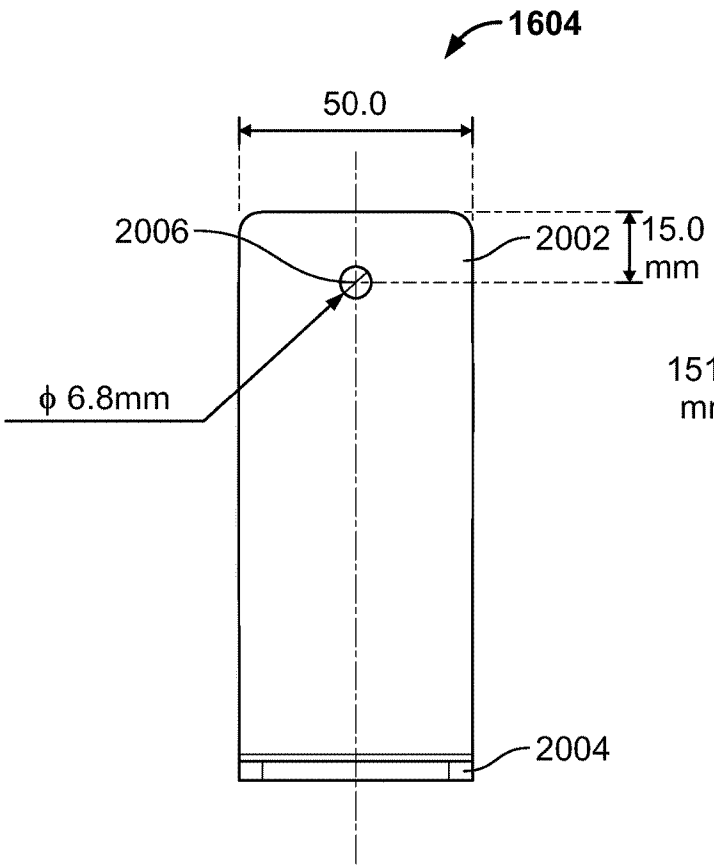

FIG. 21C is a rear view of side bracket clamp flange 1604. The rear view may show the outer face of standing side 2002. The rear view may show aperture 2006. Aperture 2006 may have a diameter of 6.8 millimeters. Aperture 2006 may be on or about 15 millimeters or anywhere between 5% of 15 millimeters from a top edge of standing side 2002. The width of standing side 2002 may be on or about 50 millimeters or anywhere between 5% of 50 millimeters.

FIG. 21D shows a flattened view of side bracket clamp flange 1604. Side bracket clamp flange 1604 may be formed from one piece of steel. Side bracket clamp flange 1604 flattened out may be a rectangle. The rectangle may have four corners. The corners may be curved corners. There may be aperture 2006 and aperture 2008 in flattened side bracket clamp flange 1604. Aperture 2008 may be on or about 13 millimeters from the bottom of side bracket clamp flange 1604. There may be a bend in side bracket clamp flange 1604. The location of the bend may be shown with a straight line found on the side bracket clamp flange. The bend may be on or about 32.2 millimeters or anywhere between 5% of 32.2 millimeters from the bottom edge. Side bracket clamp flange 1604 flattened out may be on or about 151.2 millimeters or anywhere between 5% of 151.2 millimeters from the bottom edge.

Figure 22:
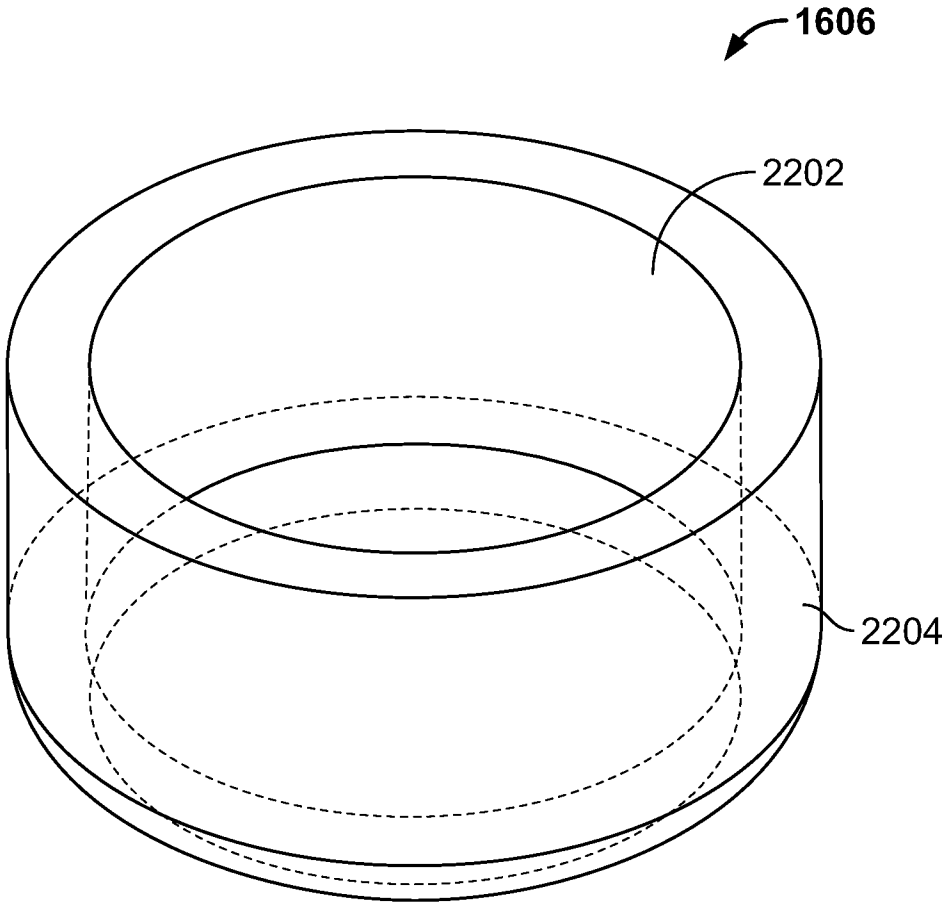
FIG. 22 shows another illustrative apparatus in accordance with principles of this matter.

FIG. 22 shows rubber tip 1606. Rubber tip 1606 may be a cylindrical shape. Rubber tip 1606 may have a cavity. The cavity may be in the bottom side of the rubber tip. The cavity may be cavity 2202. There may be a top side of rubber tip 1606. The top side may be a closed side. It may be a smooth side. There may be a cylindrical portion. It may be cylindrical portion 2204. Rubber tip 1606 may be made up of rubber or any other suitable material.

Figure 23B:
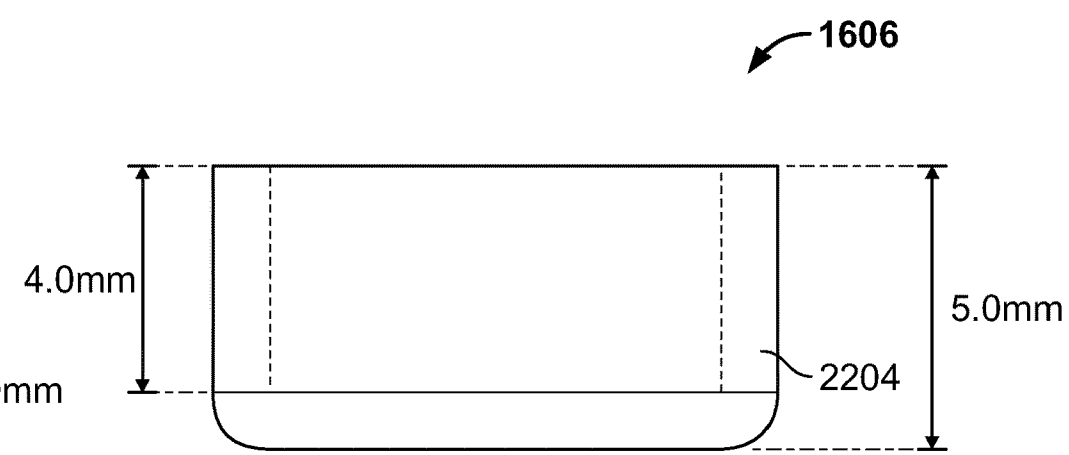
FIG. 23A-23B shows yet another illustrative apparatus in accordance with principles of this matter.
Figure 23A:
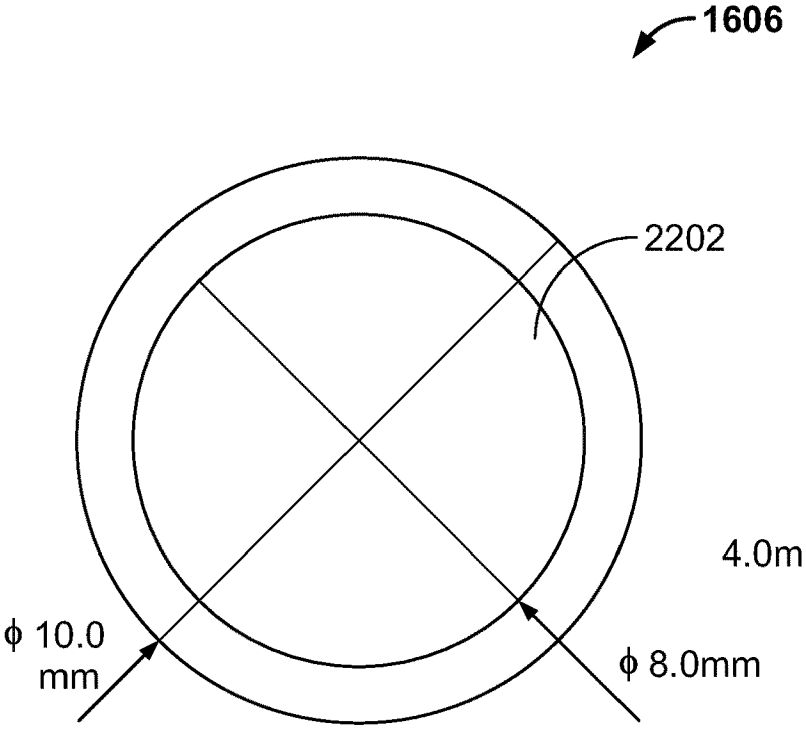

FIG. 23A shows a top view of rubber tip 1606. The top view shows an outer edge. The outer edge may be on or about 2 millimeters or anywhere between 5% of 2 millimeters thick. Cavity 2202 may be inside the outer edge. The diameter of cavity 2202 may be on or about 8 millimeters or anywhere between 5% of 8 millimeters. The diameter of the rubber tip 1606 may be on or about 10 millimeters or anywhere between 5% of 10 millimeters.

FIG. 23B is a side view of rubber tip 1606. The side view may show the height of rubber tip 1606. The height of 1606 may be on or about 5 millimeters or anywhere between 5% of 5 millimeters. The height of cavity 2202 may be on or about 4 millimeters or anywhere between 5% of 4 millimeters.

Figure 24:
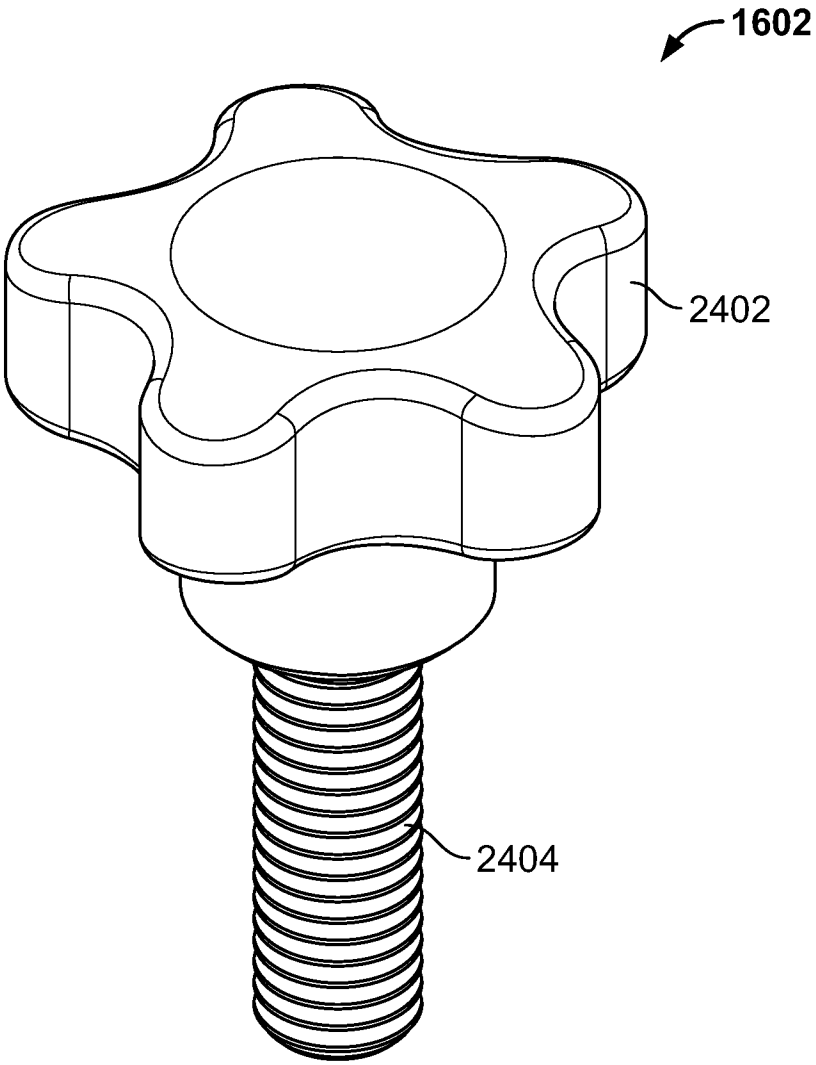
FIG. 24 shows still another illustrative apparatus in accordance with principles of this matter.

FIG. 24 shows pressure screw 1602. Pressure screw 1602 may have a head. The head may be head 2402. Head 2402 may be produced from steel or any other suitable material. Head 2402 may have a top surface. The top surface may be smooth. The top surface may not have a thread. The top surface may not have a thread to ease fastening with use of pressure screw 1602.

Pressure screw 1602 may have a male thread. The male thread may be thread 2404. Thread 2404 may be produced from steel. Thread 2404 may be on or about 25 millimeters or anywhere between 5% of 25 millimeters. Pressure screw 1602 may be threaded into aperture 2006. Rubber tip 1606 may be placed on top of pressure screw 1602.

Figure 25B:
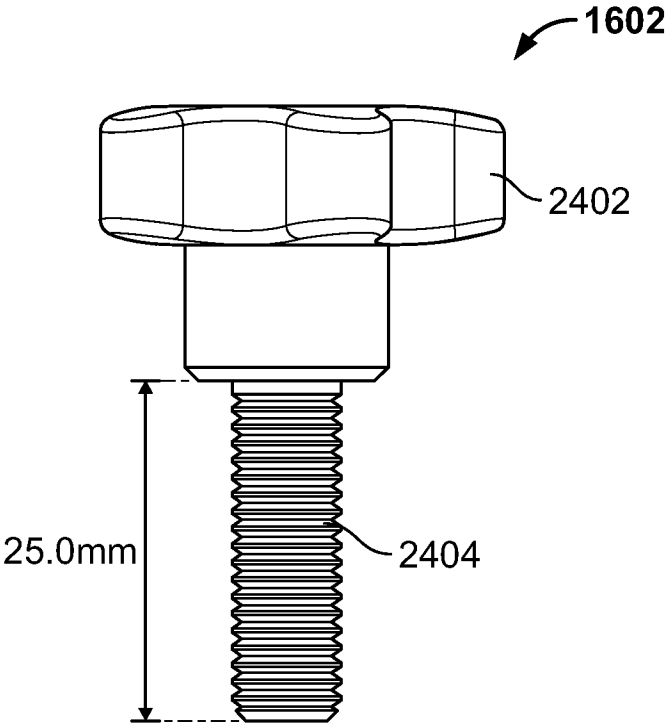
FIG. 25A-25B shows an illustrative apparatus in accordance with principles of this matter.
Figure 25A:
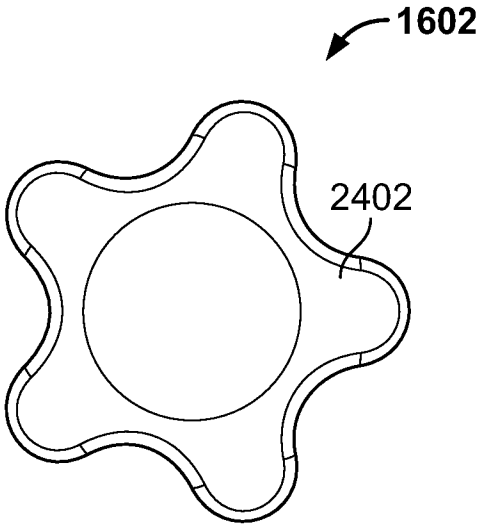

FIG. 25A is a top view of pressure screw 1602.

FIG. 25B is a side view of pressure screw 1602.

Figure 26:
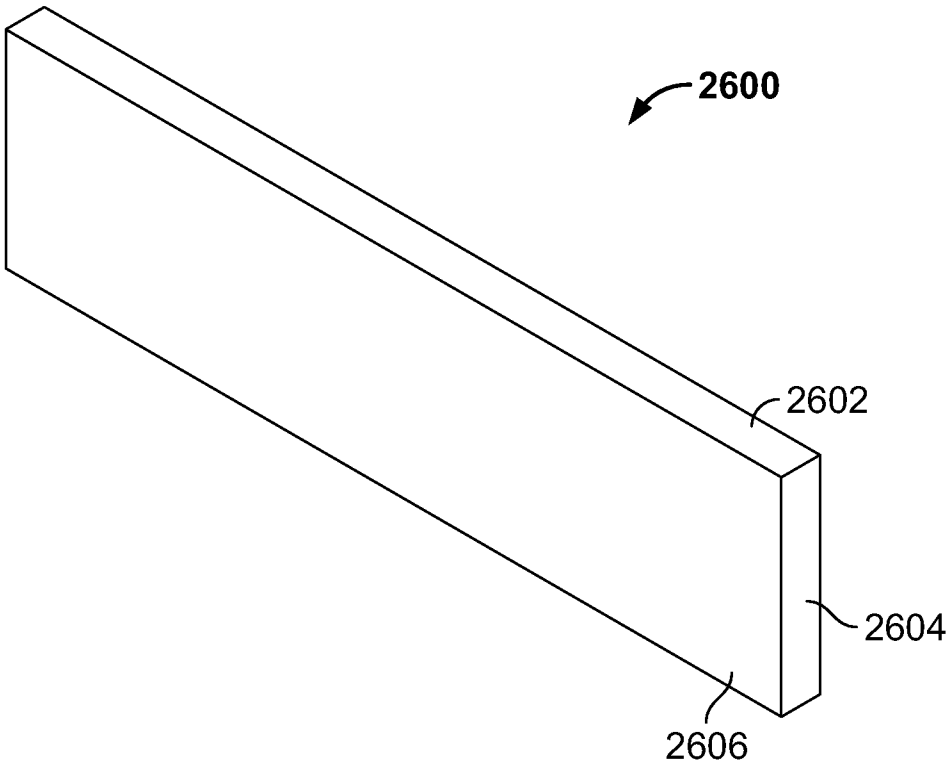
FIG. 26 shows another illustrative apparatus in accordance with principles of this matter.

FIG. 26 shows bumper 2600. Bumper 2600 may be part of the tabletop bumper kit. Bumper 2600 may be made from wood or any other suitable material. Bumper 2600 may have a finish. It may have a laminated finish. Bumper 2600 may be three quarter inches thick or any other suitable size. Bumper 2600 may have different measurements. The measurements of bumper 2600 may be made according to the size of the table. There may be a plurality of bumpers in the tabletop bumper kit. The plurality of bumpers may be for each side of the tabletop. Each bumper may be custom made to the tabletop. The length of the bumper may be slightly smaller than the length of the side of the tabletop that it may be placed on.

Bumper 2600 may be a flat rectangular shape with a length, a width and a depth. There may be six sides on the bumper. There may be top side 2602. There may be the length side 2606. There may be the width side 2604. There may be three other sides of bumper 2600.

Width side 2604 may be placed into one of the panel sleeves of the tabletop corner bracket assembly. There may be an additional width side opposite of width side 2604. The additional width side may be placed into a second panel sleeve of an additional tabletop corner bracket assembly. Length side 2606 may be placed into one of the side support brackets. Pressure screw 1602, along with rubber tip 1606 may be fastened to hold bumper 2600 in place.

Figure 27B:
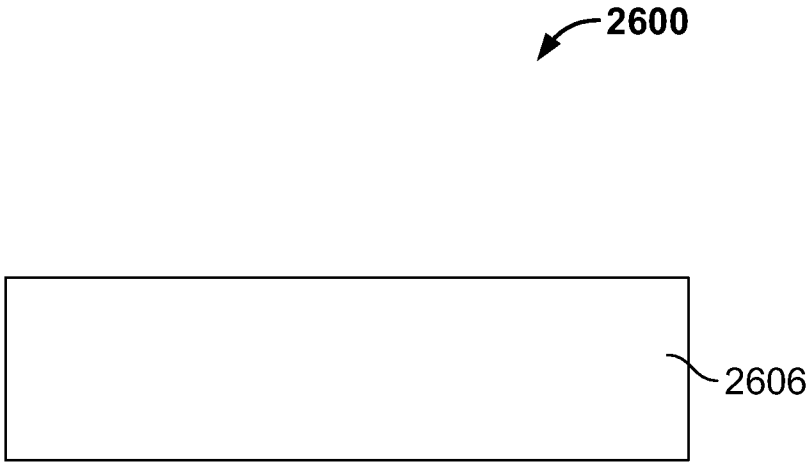
FIG. 27A-27B shows yet another illustrative apparatus in accordance with principles of this matter.
Figure 27A:
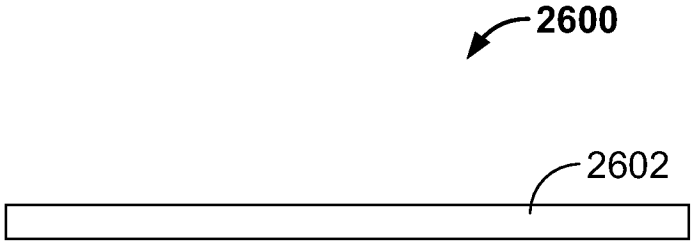

FIG. 27A is a top view of bumper 2600.

FIG. 27B is a front view of bumper 2600.

Figure 28:
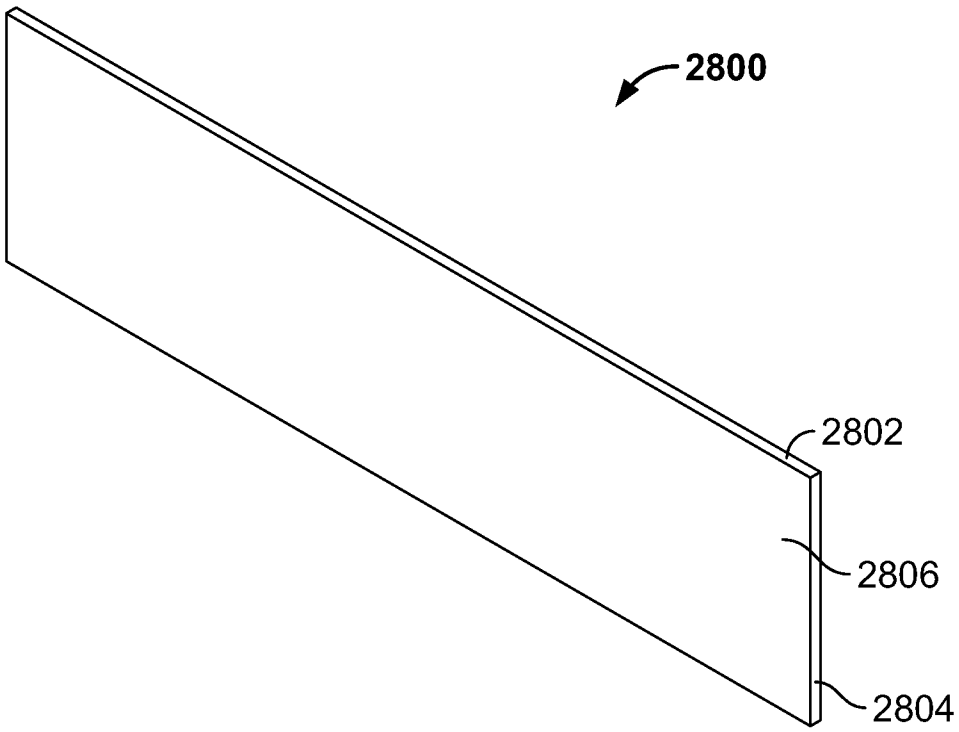
FIG. 28 shows still another illustrative apparatus in accordance with principles of this matter.

FIG. 28 shows bumper 2800. Bumper 2800 may be part of the tabletop bumper kit. Bumper 2800 may be made from acrylic or any other suitable material. Acrylic bumpers may not have a finish. Acrylic bumpers may be three sixteenths of an inch thick or any other suitable size. Bumper 2800 may have different measurements. The measurements of bumper 2800 may be made according to the size of the table. There may be a plurality of bumpers in the tabletop bumper kit. The plurality of bumpers may be for each side of the tabletop. Each bumper may be custom made to the tabletop. The bumper may be slightly smaller than the side of the tabletop that it may be placed on.

Bumper 2800 may be a flat rectangular shape with a length, a width and a depth. There may be six sides on the bumper. There may be top side 2802. There may be the length side 2806. There may be the width side 2804. There may be three other sides of bumper 2800.

Width side 2804 may be placed into one of the panel sleeves of the tabletop corner bracket assembly. There may be an additional width side opposite of width side 2804. The additional width side may be placed into a panel sleeve of an additional tabletop corner bracket assembly. There may be foam inserts inserted into the panel sleeves when the tabletop corner bracket assembly is used with acrylic bumpers. Length side 2806 may be placed into one of the side support brackets. Pressure screw 1602, along with rubber tip 1606 may be fastened to hold bumper 2800 in place.

Acrylic bumpers, wood bumpers or bumpers made of any other suitable material may come in a variety of lengths. Bumpers may also be custom made. Bumpers may have a length of 18", 24", 30", 36", 42", 48", 54", 60", 72", 84", 96" and or any suitable size. Height of each bumper may vary. Height of each bumper may vary as the adjustable clamp adjusts to the bottom of the bumper. The adjustable clamp provides no height limitation to the bumper.

Figure 29B:
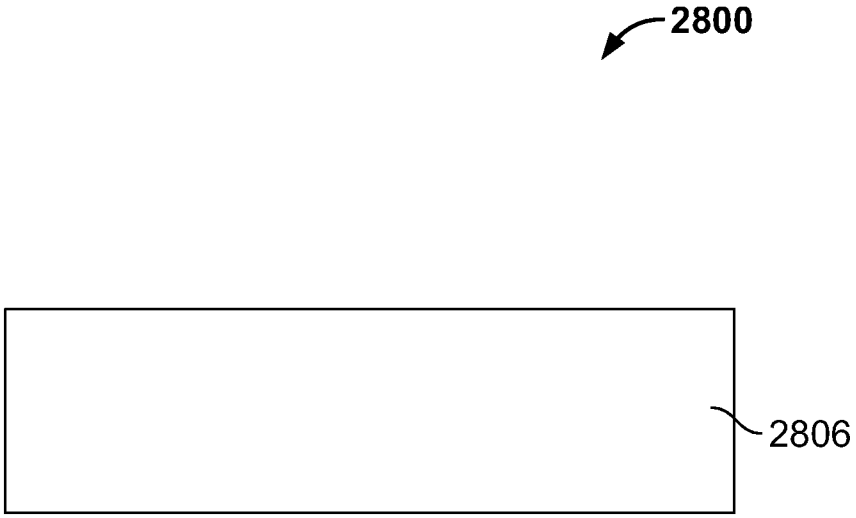
FIG. 29A-29B shows an illustrative apparatus in accordance with principles of this matter.
Figure 29A:
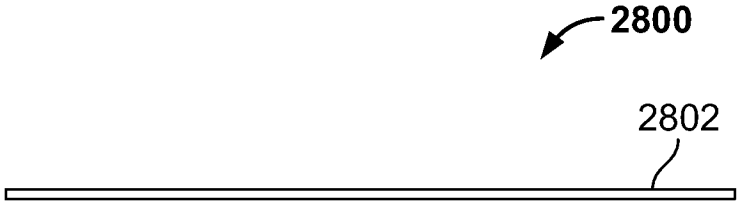

FIG. 29A is a top view of bumper 2800.

FIG. 29B is a front view of bumper 2800.

Figure 30:
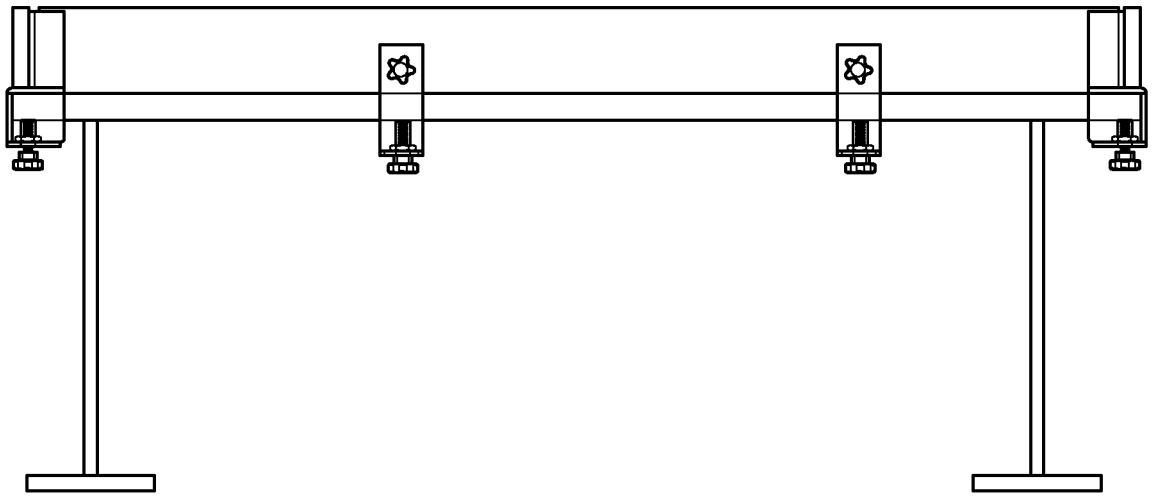
FIG. 30 shows another illustrative apparatus in accordance with principles of this matter.

FIG. 30 is a side view of an assembled tabletop bumper kit. FIG. 30 shows the assembled tabletop bumper kit. The assembled tabletop bumper kit includes the plurality of tabletop corner bracket assemblies, the plurality of side support brackets, the plurality of bumpers and the table with the tabletop.

Figure 31:
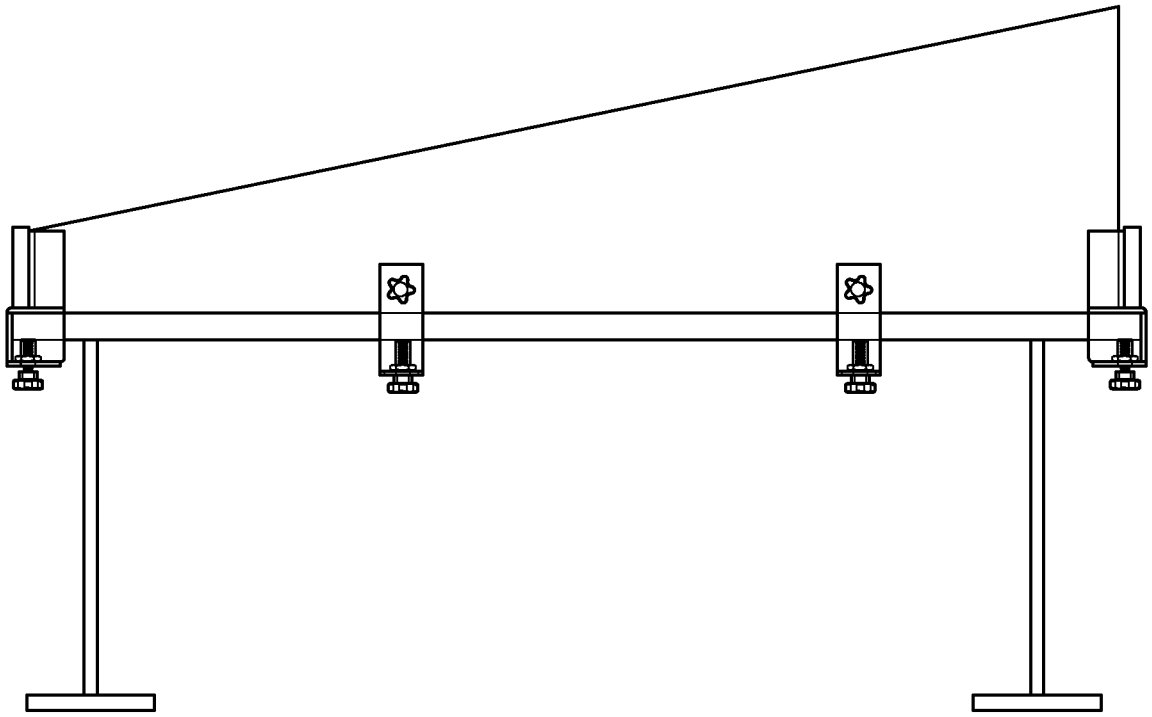
FIG. 31 shows yet another illustrative apparatus in accordance with principles of this matter.

FIG. 31 is a side view of an assembled tabletop bumper kit. The tabletop bumper kit provides no height limitation to the bumpers. The bumpers shown in FIG. 31 begin at the right side with a lower height and gradually increase to a higher height, as shown at the left side. There may be different height bumpers in the tabletop bracket assembly. Each of the bumpers included in the tabletop bumper kit may be a different height. Each bumper itself may be of different heights, as shown in FIG. 31.

Figure 32:
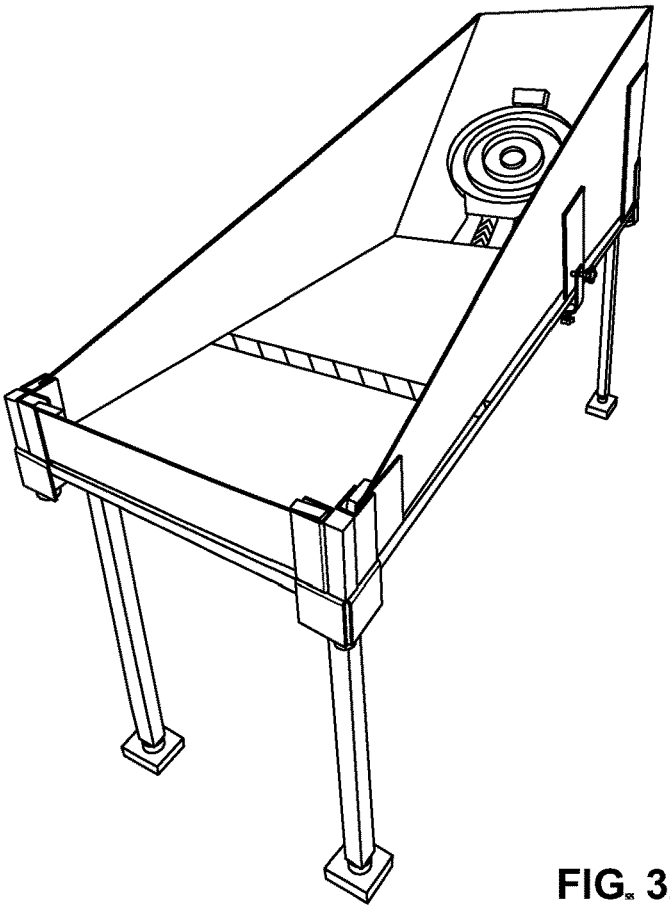
FIG. 32 shows still another illustrative apparatus in accordance with principles of this matter.

FIG. 32 is an elevational view of the tabletop bumper kit as shown in FIG. 31.

Figure 33:
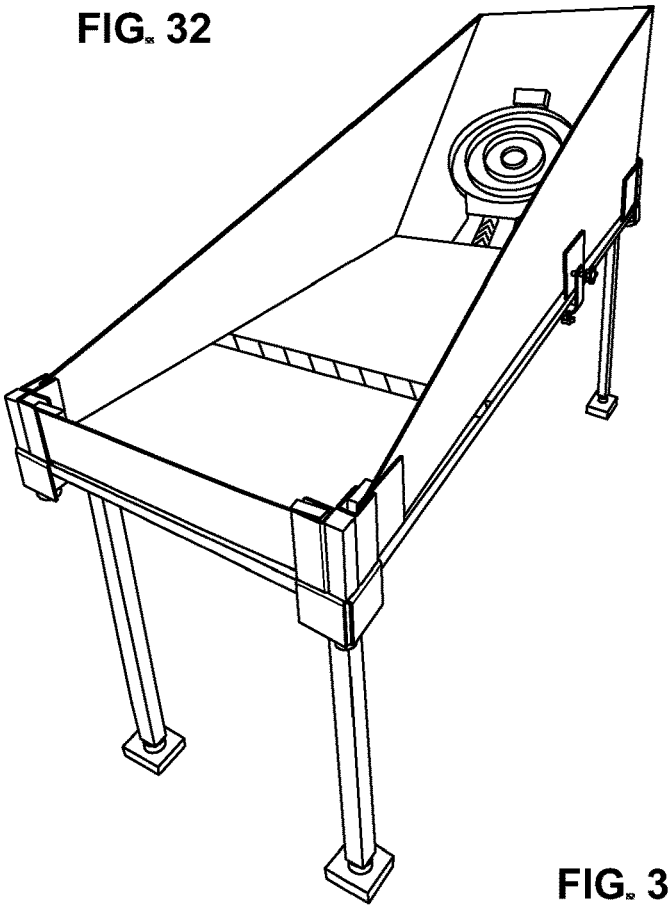
FIG. 33 shows another illustrative apparatus in accordance with principles of this matter.

FIG. 33 is an elevational view of the tabletop bumper kit as shown in FIG. 31.

Thus, methods and systems for a tabletop bumper kit are provided. Persons skilled in the art will appreciate that the present invention can be practiced by other than the described embodiments, which are presented for purposes of illustration rather than of limitation, and that the present invention is limited only by the claims that follow.

What is claimed is:

1. A tabletop bumper kit system, the tabletop bumper kit system comprising:

a plurality of tabletop corner brackets, the tabletop corner brackets configured for placement on a plurality of corners of a tabletop;

a plurality of side support brackets, the side support brackets configured for placement on a plurality of sides of the tabletop; and a plurality of bumpers;

wherein:

each of the plurality of tabletop corner brackets comprises at least one insert, said at least one insert for clasping at least one of the plurality of bumpers;

each of the plurality of side support brackets comprises at least one insert, said at least one insert for clasping at least one of the plurality of bumpers;

each of the plurality of tabletop corner brackets is configured to attach, with a first adjustable clamp, to the tabletop;

each of the plurality of side support brackets is configured to attach, with an adjustable side clamp, to at least one of the plurality of bumpers;

each of the plurality of side support brackets is configured to attach, with a second adjustable clamp, at least one of the plurality of bumpers to the tabletop; and each tabletop corner bracket houses an equal portion of two bumpers.

2. The system of claim 1 wherein;

the tabletop corner brackets and side support brackets are configured to accommodate any size rectangular table;

the tabletop corner brackets are configured to accommodate any size height;

the tabletop corner brackets are configured to accommodate any size width; and the tabletop corner brackets are configured to accommodate any size length.

3. The system of claim 1 wherein each of the plurality of side support brackets is configured with two pressure screws, wherein:

one of the two pressure screws:

is located on a bottom side of the side support bracket; and adjusts the side support bracket in accordance with a size of the tabletop; and one of the two pressure screws:

is located on a top side of the side support bracket; and adjusts the side support bracket in accordance with a width of the bumpers.

4. The system of claim 1 wherein:

the first adjustable clamp is configured to be adjusted temporarily;

the second adjustable clamp is configured to be adjusted temporarily; and the adjustable side clamp is configured to be adjusted temporarily.

5. The system of claim 1 wherein:

the tabletop corner brackets comprise steel with a powder coat; and the side support brackets comprise steel with a powder coat.

* * * * *